US008801158B2

(12) United States Patent
Honoki

(10) Patent No.: US 8,801,158 B2
(45) Date of Patent: Aug. 12, 2014

(54) IMAGE PRINTING APPARATUS

(75) Inventor: Mana Honoki, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/074,155

(22) Filed: Mar. 29, 2011

(65) Prior Publication Data

US 2011/0310198 A1 Dec. 22, 2011

(30) Foreign Application Priority Data

Jun. 17, 2010 (JP) ..... 2010-138584

(51) Int. Cl.
*B41J 2/175* (2006.01)

(52) U.S. Cl.
USPC ..... 347/86

(58) Field of Classification Search
CPC ..... B41J 2/17566
USPC ..... 347/44, 6, 7, 86
See application file for complete search history.

(56) References Cited

U.S. PATENT DOCUMENTS

| | | | | |
|---|---|---|---|---|
| 6,070,958 | A * | 6/2000 | Kanome | 347/7 |
| 6,334,658 | B1 * | 1/2002 | Suzuki | 347/7 |
| 6,793,305 | B2 * | 9/2004 | Tsukada et al. | 347/7 |
| 7,506,944 | B2 * | 3/2009 | Umeda | 347/7 |
| 7,506,955 | B2 * | 3/2009 | Yamamoto et al. | 347/23 |
| 2009/0040251 | A1 * | 2/2009 | Motominami et al. | 347/7 |

FOREIGN PATENT DOCUMENTS

| | | |
|---|---|---|
| JP | 2000-190517 | 7/2000 |
| JP | 2006-130812 | 5/2006 |
| JP | 2007-15393 | 1/2007 |
| JP | 2009-132098 | 6/2009 |

OTHER PUBLICATIONS

Chinese Official Action and Search Report dated Sep. 3, 2013 together with partial English translation received in countrpart CN application 201110083719.2.

* cited by examiner

*Primary Examiner* — Alessandro Amari
*Assistant Examiner* — Michael Konczal
(74) *Attorney, Agent, or Firm* — Scully, Scott, Murphy & Presser, P.C.

(57) ABSTRACT

An image printing apparatus including a cartridge mounting unit on which an ink cartridge is detachably mountable. The cartridge mounting unit includes a sensor configured to detect a light transmitted through a remaining amount detecting portion. The image printing apparatus further includes a counter configured to count ejected ink and a storage section configured to store a count integrated value. The image printing apparatus further includes a reset section configured to reset the value stored in the storage section. Moreover, the image printing apparatus includes a temporary count holding section configured to temporally store the integrated value stored in the storage section and restore the value of storage section in response to a trigger signal. Therefore, the image printing apparatus may reliably detect an exchange of an ink cartridge and may accurately detect a remaining amount of ink.

17 Claims, 18 Drawing Sheets

IMAGE PRINTING APPARATUS

CROSS REFERENCE TO RELATED APPLICATION

The present application claims priority from Japanese Patent Application No. 2010-138584, filed on Jun. 17, 2010, the disclosure of which is incorporated herein by reference in its entirely.

BACKGROUND

1. Technical Field

The present invention relates to an image printing apparatus on which an ink cartridge is detachably mountable.

2. Related Art

Both now and in the past, in a so-called tube supply type image printing apparatus, an ink cartridge is disposed on the outside of a carriage having a printhead mounted thereon, and the ink cartridge and the printhead are connected to each other via a tube. The ink cartridge is horizontally mounted on, for example, a cartridge mounting unit having an opening at the front side of a body via the opening. The cartridge mounting unit accommodates the ink cartridge so as to be attachable thereto and detachable therefrom. When the ink cartridge is mounted on the cartridge mounting unit, an ink passage is formed from the ink cartridge to the printhead. Ink is supplied from the ink cartridge to the printhead via the ink passage.

A remaining amount detecting unit is provided so as to detect the remaining amount of ink inside the ink cartridge, and the cartridge mounting unit is provided with a sensor that is used to detect the remaining amount detecting unit of the ink cartridge.

In order to manage the remaining amount of ink inside the ink cartridge, the known image printing apparatus counts ink droplets ejected from the printhead by using a dot counter. The dot count value is reset when the ink cartridge is exchanged. Whether the ink cartridge is exchanged is determined on the basis of the user's input. In the known image printing apparatus, the dot count value is temporarily saved before being reset in consideration of the user's erroneous input. When it is determined that an erroneous input is performed by the user, the saved dot count value may be set again executed by a user's correction input.

However, when the user recognizes the erroneous input at the time of the exchange of the ink cartridge, the dot count value may be set again by receiving a user's correction input. However, when the user does not recognize the erroneous input, the dot count value can not be set again. For example, in an image printing apparatus used by plural users, a user may input some information after exchanging the ink cartridge. In this case, since other users may not recognize the erroneous input even if the former user inputs wrong information, an image printing operation is performed without setting the dot count value again, and hence there is a concern in that a so-called void ejection may occur in which the printhead is operated without ink.

The image printing apparatus may include a unit that detects the exchange of the ink cartridge. However, when the ink cartridge is exchanged while power of the image printing apparatus is turned off, there is a problem in that the unit may not be able to detect the exchange of the ink cartridge. On the contrary, an image printing apparatus is known which determines the exchange of the ink cartridge on the basis of the result of comparison between the detection result of the remaining amount of ink before turning off power and the detection result of the remaining amount of ink upon turning on power.

However, since the exchange of the ink cartridge is determined on the basis of the detection result of the remaining amount of ink immediately after turning on power, there is a concern in that an erroneous determination may be performed when the currently used ink cartridge is inserted or extracted without mounting a new ink cartridge. More specifically, when the ink cartridge is extracted and inserted, there is a concern in that ink is adhered to the remaining amount detecting unit or bubbles are generated in the ink level when the ink level inside the ink cartridge is shaken. When the remaining amount of ink is detected before the ink adhered to the remaining amount detecting unit flows to be dropped therefrom or the bubbles are removed, there is a concern in that an erroneous determination may be performed such that ink remains in the ink cartridge due to the adhered ink or the bubbles even when the remaining amount of ink is small. When an image printing operation is performed after it is determined that the ink cartridge is exchanged on the basis of the erroneous detection result, there is a concern that void ejection of ink may occur as described above.

SUMMARY

It is desirable to provide an image printing apparatus which may reliably detect an exchange of an ink cartridge and may accurately detect a remaining amount of ink.

According to an embodiment to the present invention, an image printing apparatus comprises a printer unit including a cartridge mounting unit configured such that an ink cartridge is detachably mountable thereon. The printer unit is configured to print an image on a printing medium by ejecting ink supplied from the ink cartridge as ink droplets. The ink cartridge includes an ink chamber configured to store the ink, an ink supply port configured to discharge the ink stored in the ink chamber, and a remaining amount detecting portion configured to receive the ink from the ink chamber. The remaining amount detecting portion is configured such that a light transmission state changes in accordance with a remaining amount of the ink stored in the ink chamber.

The cartridge mounting unit includes a connecting portion configured to be connected to the ink supply port so as to receive the ink from the ink supply port while the ink cartridge is mounted on the cartridge mounting unit. The cartridge mounting unit further includes a sensor configured to detect a light transmitted through the remaining amount detecting portion while the ink cartridge is mounted on the cartridge mounting unit.

The image printing apparatus further comprises a counter configured to count the ink droplets ejected from the printer unit, a trigger signal generating section configured to generate trigger signals. The image printing apparatus still further comprises an ink remaining amount determining section configured to, in response to the trigger signals generated by the trigger signal generating section, determine at least two states of the remaining amount of the ink stored in the ink chamber on the basis of an output signal of the sensor. The image printing apparatus yet further comprises a first storage section and a second storage section. The first storage section is configured to store an ink remaining amount state determined by the ink remaining amount determining section. The second storage section is configured to store a value obtained by integrating a first count number counted by the counter after the ink remaining amount determining section determines that the remaining amount of the ink is in a first state corresponding to a small remaining amount of the ink between the two states. Moreover, the image printing apparatus comprises an operation detecting section configured to detect whether the cartridge mounting unit is operated and an exchange input section configured to receive an input informing whether the ink cartridge is exchanged on the basis of the detection result of the operation detecting section detecting whether the cartridge mounting unit is operated.

The image printing apparatus further comprises a first reset section configured to reset the value stored in the second storage section on the condition that (1) the ink remaining amount determining section determines that it is the first state in response to a first trigger signal before the operation detecting section detects that the cartridge mounting unit is operated, (2) the ink remaining amount determining section determines that it is a second state corresponding to a large remaining amount of the ink between the two states, in response to a second trigger signal generated after the operation detecting section detects that the cartridge mounting unit is operated, and (3) the exchange input section receives the input informing that the ink cartridge is exchanged.

The image printing apparatus still further comprises a temporary count holding section configured to temporally store, as an initial value, the integrated value stored in second storage section before the value is reset by the first reset section. The temporary count holding section further configured to store a second count number obtained by integrating the initial value with a count number counted by the counter until a third trigger signal is generated after the second trigger signal is generated. The temporary count holding section is still further configured to store the second count number in the second storage section on the condition that the ink remaining amount determining section determines that it is the first state in response to the third trigger signal.

According to an embodiment of the present invention, an image printing apparatus comprises a printer unit including a cartridge mounting unit configured such that an ink cartridge is detachably mountable thereon. The printer unit is configured to print an image on a printing medium by ejecting ink supplied from the ink cartridge as ink droplets. The ink cartridge includes an ink chamber configured to store the ink, an ink supply port configured to discharge the ink stored in the ink chamber, and a remaining amount detecting portion configured to receive the ink from the ink chamber. The remaining amount detecting portion is configured such that a light transmission state changes in accordance with a remaining amount of the ink stored in the ink chamber.

The cartridge mounting unit includes a connecting portion configured to be connected to the ink supply port so as to receive the ink from the ink supply port while the ink cartridge is mounted on the cartridge mounting unit. The cartridge mounting unit further includes a sensor configured to detect a light transmitted through the remaining amount detecting portion while the ink cartridge is mounted on the cartridge mounting unit.

The image printing apparatus further comprises a counter configured to count the ink droplets ejected from the printer unit, a trigger signal generating section configured to generate trigger signals. The image printing apparatus still further comprises an ink remaining amount determining section configured to, in response to the trigger signals generated by the trigger signal generating section, determine at least two states of the remaining amount of the ink stored in the ink chamber on the basis of an output signal of the sensor. The image printing apparatus yet further comprises a first storage section and a second storage section. The first storage section is configured to store an ink remaining amount state determined by the ink remaining amount determining section. The second storage section is configured to store a value obtained by integrating a first count number counted by the counter after the ink remaining amount determining section determines that the remaining amount of the ink is in a first state corresponding to a small remaining amount of the ink between the two states. Moreover, the image printing apparatus comprises an operation detecting section configured to detect whether the cartridge mounting unit is operated and an exchange input section configured to receive an input informing whether the ink cartridge is exchanged on the basis of the detection result of the operation detecting section detecting whether the cartridge mounting unit is operated.

The image printing apparatus further comprises a second reset section configured to reset the value stored in the second storage section on the condition that (1) the ink remaining amount determining section determines that it is the first state in response to the first trigger signal before the operation detecting section detects that the cartridge mounting unit is operated, (2) the exchange input section receives an input informing that the ink cartridge is not exchanged after the operation detecting section detects that the cartridge mounting unit is operated, and (3) the ink remaining amount determining section determines that it is a second state having a large remaining amount of ink between the two states in response to a second trigger signal generated after the operation detecting section detects that the cartridge mounting unit is operated.

According to an embodiment to the present invention, an image printing apparatus comprises a printer unit including a cartridge mounting unit configured such that an ink cartridge is detachably mountable thereon. The printer unit is configured to print an image on a printing medium by ejecting ink supplied from the ink cartridge as ink droplets. The ink cartridge includes an ink chamber configured to store the ink, an ink supply port configured to discharge the ink stored in the ink chamber, and a remaining amount detecting portion configured to receive the ink from the ink chamber. The remaining amount detecting portion is configured such that a light transmission state changes in accordance with a remaining amount of the ink stored in the ink chamber.

The cartridge mounting unit includes a connecting portion configured to be connected to the ink supply port so as to receive the ink from the ink supply port while the ink cartridge is mounted on the cartridge mounting unit. The cartridge mounting unit further includes a sensor configured to detect a light transmitted through the remaining amount detecting portion while the ink cartridge is mounted on the cartridge mounting unit.

The image printing apparatus further comprises a counter configured to count the ink droplets ejected from the printer unit, a trigger signal generating section configured to generate trigger signals. The image printing apparatus still further comprises an ink remaining amount determining section configured to, in response to the trigger signals generated by the trigger signal generating section, determine at least two states of the remaining amount of the ink stored in the ink chamber on the basis of an output signal of the sensor. The image printing apparatus yet further comprises a first storage section and a second storage section. The first storage section is configured to store an ink remaining amount state determined by the ink remaining amount determining section. The second storage section is configured to store a value obtained by integrating a first count number counted by the counter after the ink remaining amount determining section determines that the remaining amount of the ink is in a first state corresponding to a small remaining amount of the ink between the two states. Moreover, the image printing apparatus comprises an operation detecting section configured to detect whether the cartridge mounting unit is operated and an exchange input section configured to receive an input informing whether the ink cartridge is exchanged on the basis of the detection result of the operation detecting section detecting whether the cartridge mounting unit is operated.

The image printing apparatus further comprises a third reset section configured to reset the value stored in the second storage section on the condition that (1) the ink remaining amount determining section determines that it is the first state in response to the first trigger signal before the operation detecting section detects that the cartridge mounting unit is operated, (2) the ink remaining amount determining section determines that it is a second state corresponding to a large remaining amount of the ink between the two states, in response to a second trigger signal generated after the operation detecting section detects that the cartridge mounting unit is operated, and (3) the ink remaining amount determining section determines that it is the second state in response to a third trigger signal subsequently after the second trigger signal.

According to an embodiment to the present invention, an image printing apparatus comprises a printer unit including a cartridge mounting unit configured such that an ink cartridge is detachably mountable thereon. The printer unit is configured to print an image on a printing medium by ejecting ink supplied from the ink cartridge as ink droplets. The ink cartridge includes an ink chamber configured to store the ink, an ink supply port configured to discharge the ink stored in the ink chamber, and a remaining amount detecting portion configured to receive the ink from the ink chamber. The remaining amount detecting portion is configured such that a light transmission state changes in accordance with a remaining amount of the ink stored in the ink chamber.

The cartridge mounting unit includes a connecting portion configured to be connected to the ink supply port so as to receive the ink from the ink supply port while the ink cartridge is mounted on the cartridge mounting unit. The cartridge mounting unit further includes a sensor configured to detect a light transmitted through the remaining amount detecting portion while the ink cartridge is mounted on the cartridge mounting unit.

The image printing apparatus further comprises a counter configured to count the ink droplets ejected from the printer unit, a trigger signal generating section configured to generate trigger signals. The image printing apparatus still further comprises an ink remaining amount determining section configured to, in response to the trigger signals generated by the trigger signal generating section, determine at least two states of the remaining amount of the ink stored in the ink chamber on the basis of an output signal of the sensor. The image printing apparatus yet further comprises a first storage section and a second storage section. The first storage section is configured to store an ink remaining amount state determined by the ink remaining amount determining section. The second storage section is configured to store a value obtained by integrating a first count number counted by the counter after the ink remaining amount determining section determines that the remaining amount of the ink is in a first state corresponding to a small remaining amount of the ink between the two states. Moreover, the image printing apparatus comprises a power detecting section configured to detect whether the image printing apparatus changes from an OFF state to an ON state.

The image printing apparatus further comprises a fourth reset section configured to reset the integrated value stored in the second storage section on the condition that (1) the ink remaining amount determining section determines that it is the first state in response to a fourth trigger signal before the power detecting section detects that the power is turned on, (2) the ink remaining amount determining section determines that it is a second state corresponding to a large remaining amount of the ink between the two states, in response to a fifth trigger signal generated after the power detecting section detects that the power is turned on, and (3) the ink remaining amount determining section determines that it is the second state in response to a sixth trigger signal subsequently after the fifth trigger signal.

BRIEF DESCRIPTION OF THE DRAWINGS

For a more complete understanding of the present invention, the needs satisfied thereby, and the features and advantages thereof, reference now is made to the following descriptions taken in connection with the accompanying drawings wherein.

DESCRIPTION OF PREFERRED EMBODIMENTS

Figure 1:
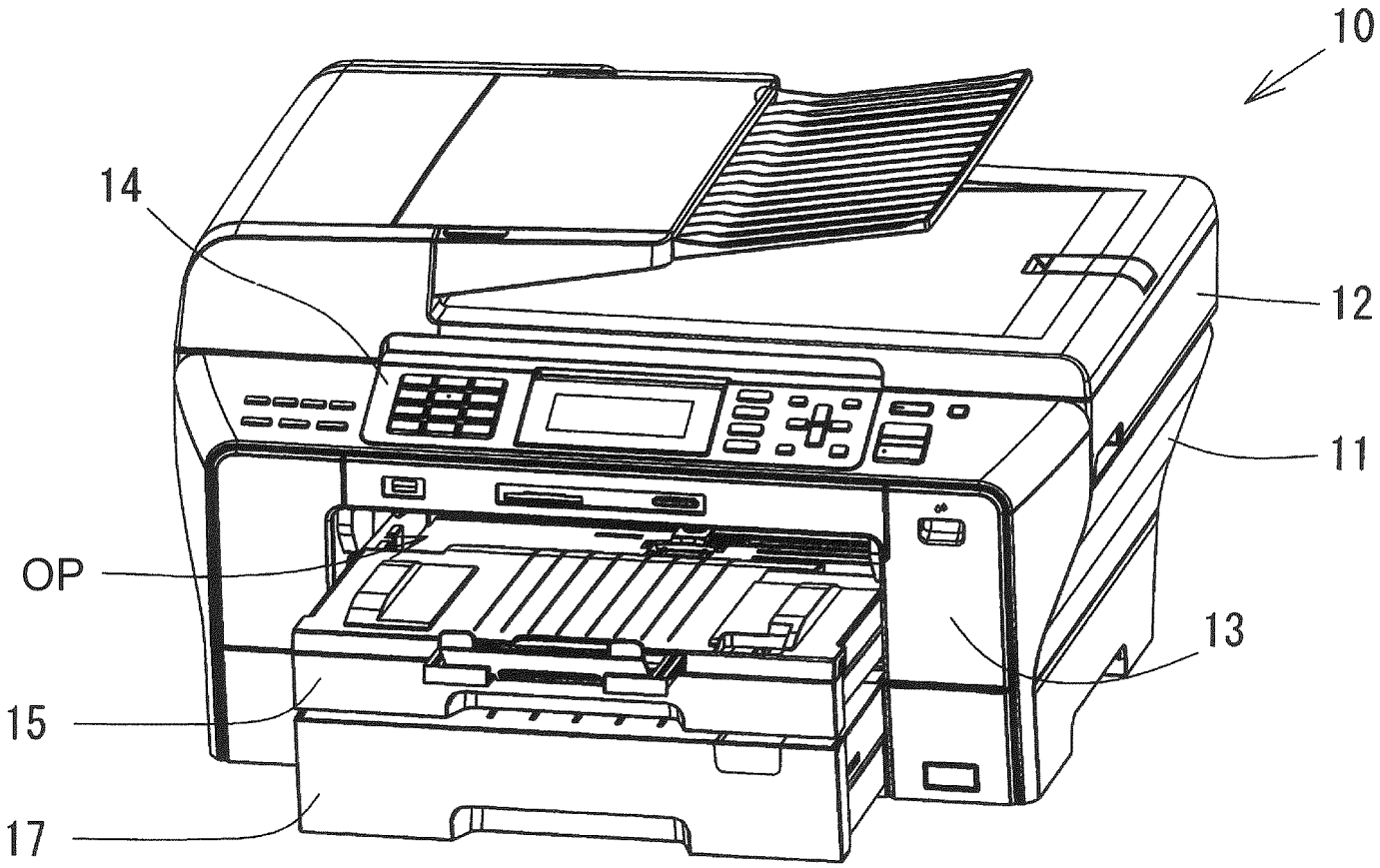
FIG. 1 is a perspective view illustrating an external configuration of a multi-functional apparatus.

Embodiments of the invention and their features and advantages may be understood by referring to FIGS. 1-18, like numerals being used for like corresponding parts in the various drawings. Hereinafter, an embodiment of the invention will be described by appropriately referring to the drawings. Further, the embodiment to be described below is merely an example of the invention, and may be, of course, appropriately modified within the scope in which the concept of the invention is not changed.

[Schematic Configuration of Multi-Functional Apparatus 10]

As shown in FIG. 1, a multi-functional apparatus 10 integrally includes a printer unit 11 and a scanner unit 12, and has a print function, a scan function, a copy function, and a facsimile function. The multi-functional apparatus 10 is an example of an image printing apparatus. Further, the other functions not performed by the printer unit 11 may be arbitrarily selected, and for example, the image printing apparatus according to an embodiment of the invention may be realized as a printer without the scanner unit 12 and having a single function without having the scan function nor the copy function.

In the multi-functional apparatus 10, the printer unit 11 is disposed at the lower side thereof, and the scanner unit 12 is disposed at the upper side thereof. The printer unit 11 is mainly connected to an external information device such as a computer, and prints an image or a character on a printing medium on the basis of print data including document data and image data transmitted from the external information device. The scanner unit 12 is a so-called flat bed scanner.

The multi-functional apparatus 10 is substantially formed in a rectangular parallelepiped shape having a wide width and a thin thickness. The printer unit 11 has an opening OP formed at the front surface thereof. The opening OP has therein a paper feeding tray 15 and a paper discharging tray 16. A printing paper accommodated in the paper feeding tray 15 is fed to the inside of the printer unit 11, and the printing paper having a desired image formed thereon is discharged to the paper discharging tray 16.

An operation panel 14 is provided at the front upper portion of the multi-functional apparatus 10. In the operation panel 14, a predetermined input is performed thereon so as to allow the printer unit 11 and the scanner unit 12 to perform a desired operation. The operation panel 14 is provided with plural buttons used to input something therethrough or a display displaying the state of the remaining amount of ink or error. Further, when the multi-functional apparatus 10 is connected to the external information device, the multi-functional apparatus 10 is operated on the basis of a command transmitted from the external information device via communication software such as a printer driver or a scanner driver. The operation panel 14 is an example of both an exchange input section and an ink remaining amount displaying section.

[Outline of Printer Unit 11]

Figure 2:
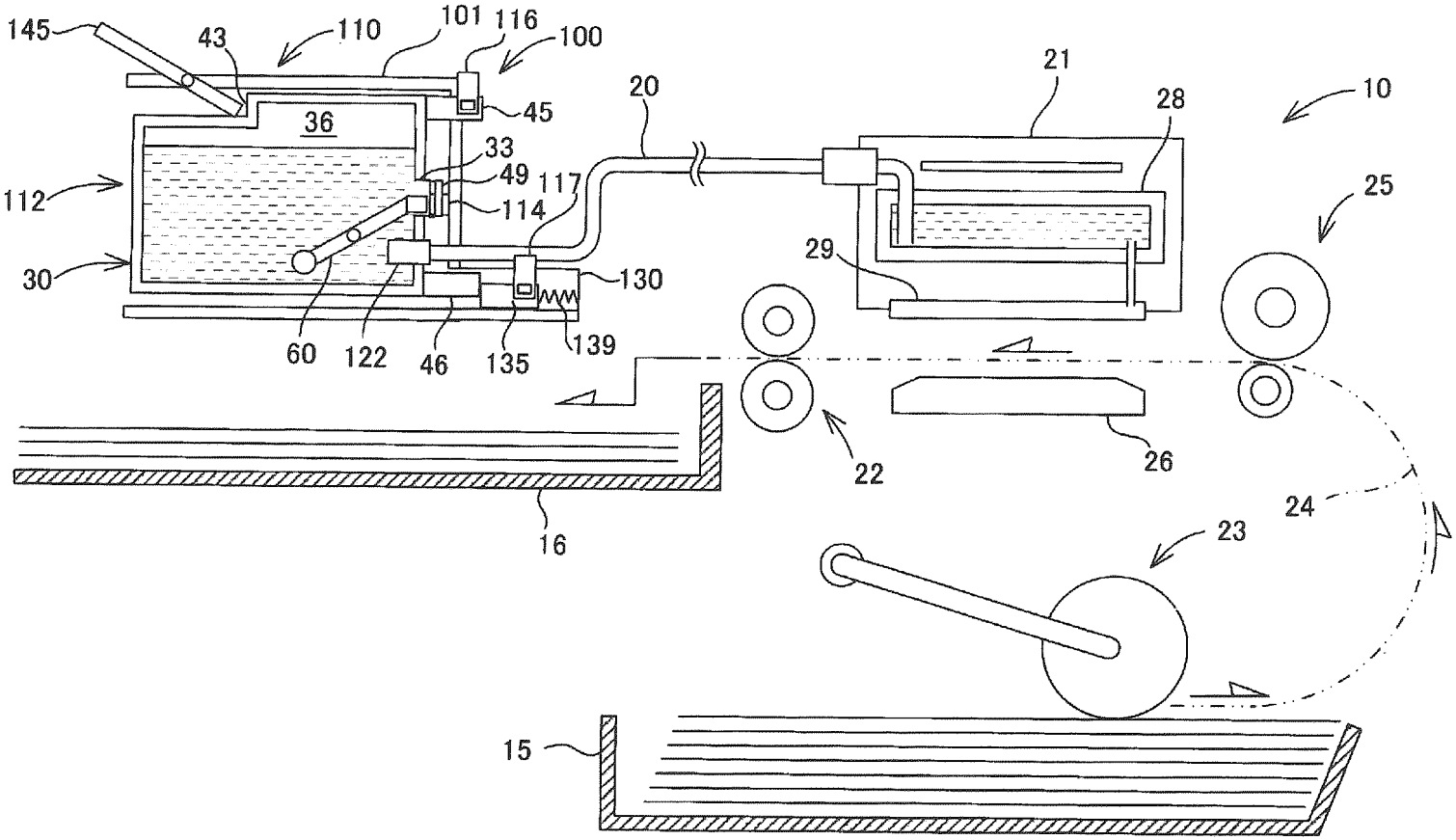
FIG. 2 is a cross-sectional view schematically illustrating an internal structure of a printer unit.

As shown in FIG. 2, the printer unit 11 prints an image by selectively ejecting an ink droplet onto the printing paper on the basis of the ink-jet printing method. The printer unit 11 includes an ink supply device 100. The ink supply device 100 is provided with a cartridge mounting unit 110. An ink cartridge 30 may be mounted on the cartridge mounting unit 110. The cartridge mounting unit 110 is provided with an opening 112 of which one surface is opened to the outside. The ink cartridge 30 is inserted into the cartridge mounting unit 110 via the opening 112 or is extracted from the cartridge mounting unit 110 via the opening. The opening 112 shown in FIG. 1 is opened or closed by a cover 13. Although not shown in the same drawing, the opened or closed state of the cover 13 is detected by a cover sensor 124.

The ink cartridge 30 stores ink that may be used by the printer unit 11. While the ink cartridge 30 is mounted on the cartridge mounting unit 110, the ink cartridge 30 and a printhead 21 are connected to each other via an ink tube 20. The printhead 21 is provided with a sub-tank 28. The sub-tank 28 temporarily stores ink supplied via the ink tube 20. The printhead 21 selectively ejects ink supplied from the sub-tank 28 from a nozzle 29 in accordance with the ink-jet printing method.

The printing paper fed from the paper feeding tray 15 to a transportation path 24 by a paper feeding roller 23 is transported onto a platen 26 by a pair of transportation rollers 25. The printhead 21 selectively ejects ink onto the printing paper passing on the platen 26. Accordingly, an image is printed on the printing paper. The printing paper passing through the platen 26 is discharged to a paper discharging tray 16 provided on the most downstream side of the transportation path 24 by a pair of discharge rollers 22. Further, although a second tray 17 is provided below the paper feeding tray 15 in FIG. 1, since the second tray 17 has an arbitrary configuration, the detailed description thereof will not be repeated herein.

Figure 3:
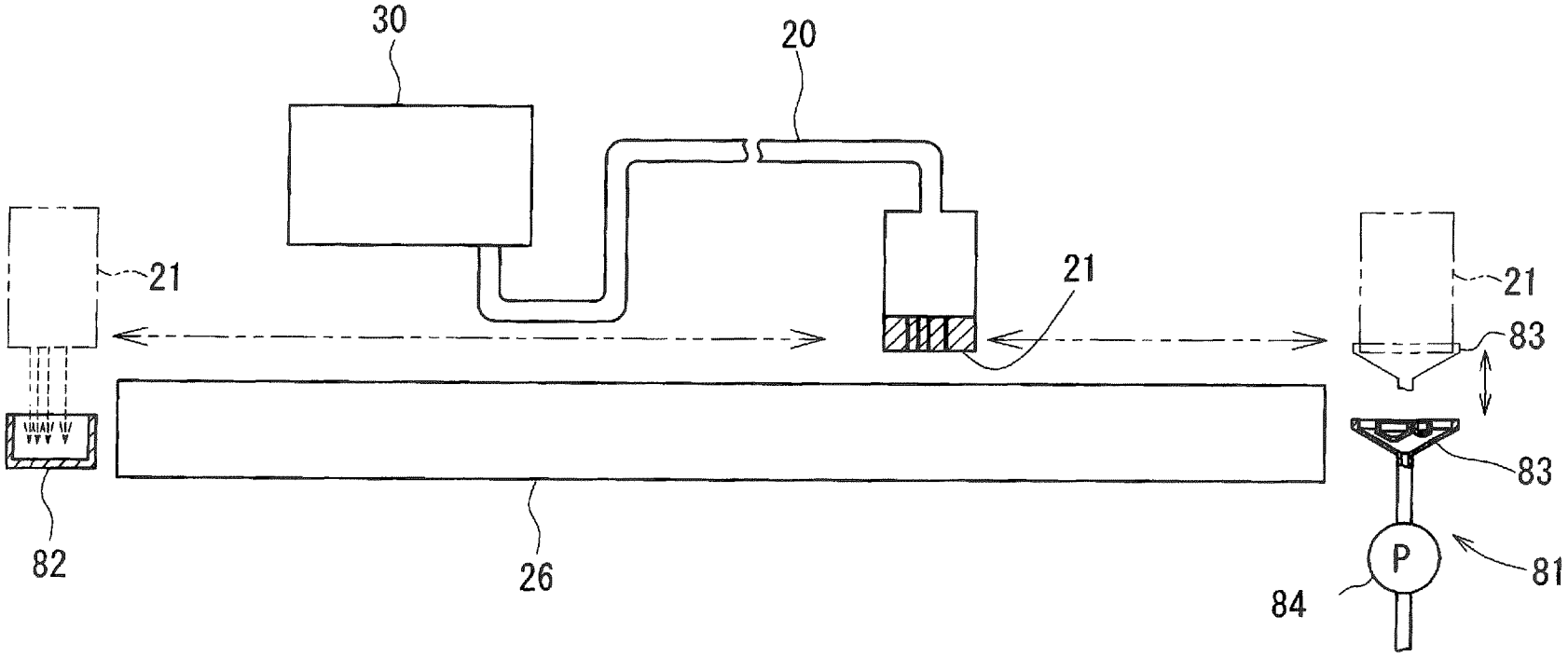
FIG. 3 is a schematic view illustrating a cleaning mechanism and a waste ink tray.

As shown in FIG. 3, a cleaning mechanism 81 and a waste ink tray 82 are respectively disposed at both ends of a scanning range on the outside of an image printing range of the printhead 21. The cleaning mechanism 81 is used to suck and remove bubbles or foreign matter from the nozzles of the printhead 21. In the cleaning operation, the printhead 21 moves to the right end of the scanning range, a cap 83 of the cleaning mechanism 81 moves upward and comes into close contact with the lower surface of the printhead 21 so as to surround the periphery of the nozzle, and a pump 84 connected to the cap 83 performs a suction operation, so that ink is sucked from the nozzles of the printhead 21.

The waste ink tray 82 is used to receive void ejection of ink from the printhead 21, where the void ejection of ink is a so-called flushing operation. In the flushing operation, the printhead 21 moves to the left end of the scanning range, and an ink droplet is ejected at that position from the printhead 21 toward the waste ink tray 82.

[Ink Cartridge 30]

Figure 4:
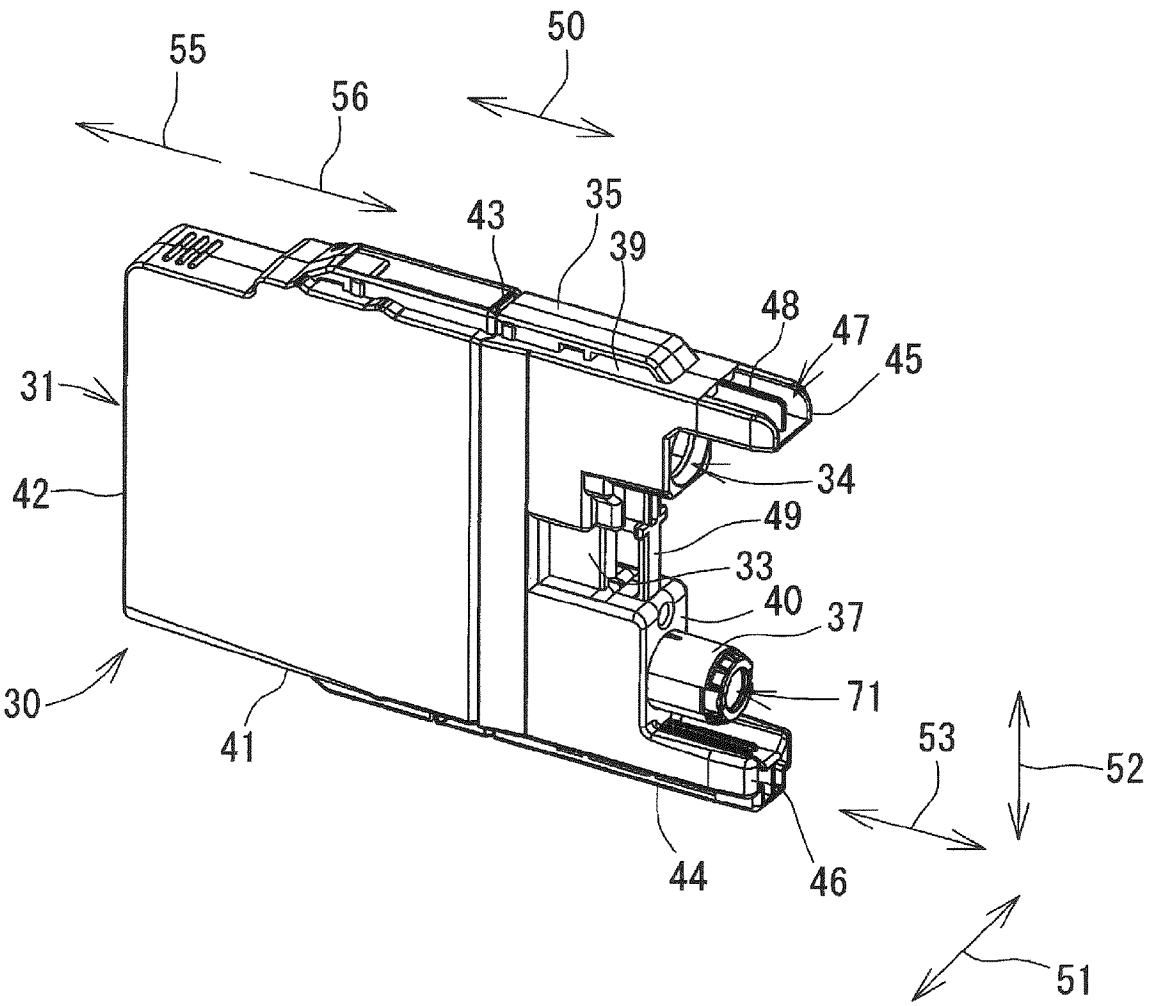
FIG. 4 is a perspective view illustrating an external configuration of an ink cartridge.
Figure 5:
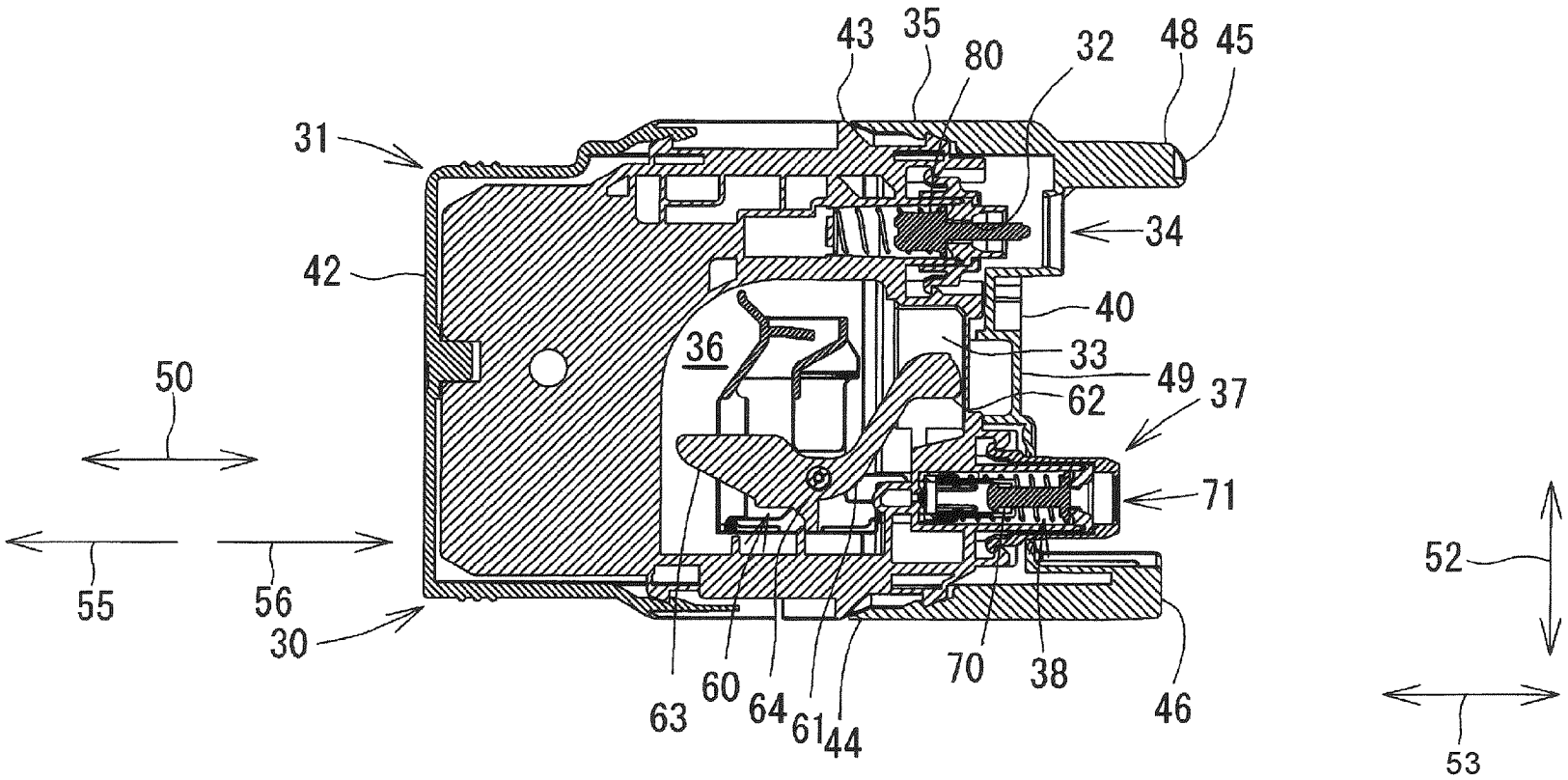
FIG. 5 is a longitudinal sectional view illustrating an internal configuration of the ink cartridge.

As shown in FIGS. 4 and 5, the ink cartridge 30 is a container which stores ink. The space formed inside the ink cartridge 30 is an ink chamber 36 which stores ink. The ink chamber 36 may be formed by a body 31 forming the external shape of the ink cartridge 30 or may be formed by members other than the body 31.

The ink cartridge 30 is inserted to or extracted from the cartridge mounting unit 110 along a direction (hereinafter, referred to as an inserting/extracting direction 50) indicated by an arrow 50 in the upright state shown in FIGS. 4 and 5, that is, the state where the lower side of the same drawing is set as a bottom surface and the upper side of the same drawing is set as a top surface. The ink cartridge 30 is inserted to or extracted from the cartridge mounting unit 110 in the upright state. The upright state corresponds to the mounting attitude. The direction in which the ink cartridge 30 is mounted on the cartridge mounting unit 110 is a mounting direction 56, the direction in which the ink cartridge 30 is extracted from the cartridge mounting unit 110 is an extracting direction 55. Further, a height direction 52 in the upright state corresponds to a direction of gravity. That is, the ink cartridge 30 is inserted into the cartridge mounting unit 110 along the inserting/extracting direction 50, and is extracted from the cartridge mounting unit 110 along the inserting/extracting direction 50.

The ink cartridge 30 includes a substantially rectangular parallelepiped body 31. The body 31 is formed in a flat plate shape which is thin in a width direction (left/right direction) 51, and the sizes in the height direction 52 and the depth direction (front/rear direction) 53 are larger than the size in the width direction 51. When the ink cartridge 30 is mounted on the cartridge mounting unit 110, the wall of the body 31 as the front side of the mounting direction 56 is a front wall 40, and the wall of the body 31 as the rear side of the mounting direction 56 is a rear wall 42. The front wall 40 and the rear wall 42 face each other in the inserting/extracting direction 50. The front wall 40 and the rear wall 42 are respectively divided by four walls, that is, a pair of left and right side walls extending in the inserting/extracting direction 50, an upper wall 39 connecting the side wall, the front wall 40, and the rear wall 42 to each other and extending from the upper end of the front wall 40 toward the upper end of the rear wall 42, and a lower wall 41 extending from the lower end of the front wall 40 toward the lower end of the rear wall 42. Further, the inserting/extracting direction 50 is parallel to the depth direction 53.

A remaining amount detecting unit 33 is provided in the vicinity of the center of the height direction 52 in the front wall 40 of the body 31. The remaining amount detecting unit 33 is disposed at the rear side of the mounting direction 56 in relation to a front end of the mounting direction 56 of a rib 48 of a first projection 45 to be described later, a front end of the mounting direction 56 of a second projection 46, and a detecting piece 49. The remaining amount detecting unit 33 is formed in a box shape of which one side is opened so as to communicate with the ink chamber 36. Further, the remaining amount detecting unit 33 includes a pair of walls which is formed of a transmissive resin allowing light emitted from an optical sensor 114 (refer to FIG. 6) to be transmitted therethrough.

As shown in FIG. 5, a gap between the pair of left and right walls of the remaining amount detecting unit 33 is formed to be hollow so as to store ink therein. An indicator portion 62 of a sensor arm 60 is located between the pair of left and right walls of the remaining amount detecting unit 33. The sensor arm 60 is formed such that both ends of a plate-shaped arm body 61 are respectively provided with the indicator portion 62 and a float portion 63. The sensor arm 60 is rotatably supported by a support shaft 64 that extends in the width direction 51 of the ink chamber 36. The sensor arm 60 may take a lower position attitude in which the indicator portion 62 is located at the lower position in the direction of gravity of the remaining amount detecting unit 33 or an upper position attitude in which the indicator portion 62 is located at the upper position in the direction of gravity of the remaining amount detecting unit 33 in response to the remaining amount of ink in the ink chamber 36. Further, FIG. 5 shows a state where a predetermined amount or more of ink is present, and the indicator portion 62 takes the lower position attitude.

When the ink cartridge 30 is mounted on the cartridge mounting unit 110, the remaining amount detecting unit 33 may be in a state where a predetermined amount or more of infrared light is transmitted to the optical sensor 114 mounted on the cartridge mounting unit 110 or a state where the infrared light is blocked or attenuated by the remaining amount detecting unit 33 to be less than a predetermined amount. When the indicator portion 62 takes the upper position attitude, the remaining amount detecting unit 33 allows the infrared light to be transmitted. When the indicator portion 62 takes the lower position attitude, the remaining amount detecting unit 33 blocks or attenuates the infrared light. In accordance with the transmissive state of the remaining amount detecting unit 33, it is determined whether the remaining amount of ink inside the ink chamber 36 is less than a predetermined amount.

Further, the remaining amount detecting unit 33 may not be equipped with the sensor arm 60. As described below, the optical sensor 114 has a structure in which a light emitting element 118 and a light receiving element 119 face each other in the horizontal direction. Then, the light emitted from the light emitting element 118 is received by the light receiving element 119. Then, when ink remains in the remaining amount detecting unit 33, the infrared light emitted from the light emitting element 118 is blocked or attenuated. When ink does not remain in the remaining amount detecting unit 33, the infrared light emitted from the light emitting element 118 may be transmitted by a predetermined amount or more. Further, the remaining amount detecting unit 33 may be formed of a smooth film. That is, when ink remains in the remaining amount detecting unit 33, the film is expanded, and the film contacts a rotatable lever, so that the lever is maintained at a position where the infrared light is blocked. On the other hand, when ink does not remain in the remaining amount detecting unit 33, the film may be contracted, and the rotatable lever may rotate downward or upward so as to be located at a position where the infrared light is not blocked. Further, when ink remains in the remaining amount detecting unit 33, the infrared light emitted from the light emitting element 118 may be reflected so as not to reach the light receiving element 119. When ink does not remain in the remaining amount detecting unit 33, the infrared light emitted from the light emitting element 118 may be reflected so as to reach the light receiving element 119.

As shown in FIG. 5, an opening 34 is formed at the upper side of the remaining amount detecting unit 33 in the front wall 40 of the body 31 so as to penetrate the front wall 40 in the depth direction 53, and an atmospheric air communication port 32 is provided at the side of the rear wall 42 than the opening 34 in the inserting/extracting direction 50. The atmospheric air communication port 32 is a through hole that perforates the wall forming the ink chamber 36 in the depth direction 53. The air layer of the ink chamber 36 may communicate with the atmosphere via the atmospheric air communication port 32.

The atmospheric air communication port 32 is configured to be opened or closed by an atmospheric air communication valve 80. When the atmospheric air communication port 32 is opened, the atmospheric pressure of the ink chamber 36 maintained at a negative pressure becomes the outside atmospheric pressure. The atmospheric air communication port 32 may not be necessarily provided at the side of the front wall 40, and the disposition thereof is not limited so long as the inside and the outside of the ink chamber 36 may communicate with each other. Further, when the ink cartridge 30 is used while the ink chamber 36 is maintained at a negative pressure, the atmospheric air communication port 32 may not be necessarily provided.

As shown in FIG. 5, an ink supply unit 37 is provided at the lower side of the remaining amount detecting unit 33 in the front wall 40 of the body 31. The ink supply unit 37 has a cylindrical shape, and protrudes outward from the front wall 40 in the inserting/extracting direction 50. The projecting end of the ink supply unit 37 is provided with an ink supply port 71. An ink flow channel 38 is formed so as to extend from the ink supply port 71 in the inserting/extracting direction 50 via the internal space of the ink supply unit 37 and to communicate with the ink chamber 36. The ink supply port 71 is configured to be opened or closed by the ink supply valve 70. When the ink cartridge 30 is mounted on the cartridge mounting unit 110, an ink needle 122 (refer to FIG. 8) provided in the cartridge mounting unit 110 is inserted into the ink supply port 71, so that the ink supply valve 70 is opened. Accordingly, ink flows out from the ink chamber 36 to the ink needle 122 provided in the cartridge mounting unit 110 via the ink flow channel 38.

Further, the ink supply port 71 may not be necessarily configured to be opened or closed by the ink supply valve 70. For example, when the ink supply port 71 is blocked by a film or the like, and the ink cartridge 30 is mounted on the cartridge mounting unit 110, the ink needle 122 may tear the film, so that the ink supply port 71 is opened.

An engaged portion 43 is formed around the center of the depth direction 53 of the upper wall 39 of the body 31. The engaged portion 43 is a projection that has a plane extending in the width direction 51 and the height direction 52 of the ink cartridge 30. A lock lever 145 engages with the engaged portion 43 while the ink cartridge 30 is mounted on the cartridge mounting unit 110. The engaged portion 43 receives a biasing force that extrudes the ink cartridge 30 in the extracting direction 55.

The body 31 is provided with the first projection 45 and the second projection 46. The first projection 45 is formed at the upper end of the front wall 40 of the body 31 so as to extend from the front wall 40 and protrudes away from the ink chamber 36 in the direction (mounting direction 56) away from the rear wall 42. The width of the first projection 45 is equal to the width of the front wall 40. The first projection 45 protrudes from the front wall 40 in the direction (mounting direction 56) away from the rear wall 42. The front end of the first projection 45 protrudes to the front side of the direction (mounting direction 56) away from the rear wall 42 more than the ink supply port 71 as the front end of the ink supply unit 37. In the embodiment, the width of the first projection 45 is equal to the width of the front wall 40, but the first projection may be formed in a plate shape of which the width is narrower than the width (in the lengthwise and widthwise directions) of the front wall 40. A groove 47 is formed at the center of the width direction 51 in the first projection 45 so as to extend in the depth direction 53. The groove 47 is opened upward in the height direction 52 of the first projection 45. The cross-sectional shape of the groove 47 in the height direction 52 is a concave shape. Further, the front end of the groove 47 in a direction away from the ink chamber 36 is opened.

The rib 48 is formed at the center of the width direction 51 of the bottom surface of the groove 47 in the internal space of the groove 47 so as to extend in the height direction 52 and the depth direction 53. The rib 48 is uprightly formed from the bottom surface of the groove 47. Both side surfaces of the width direction 51 of the rib 48 respectively face a pair of side surfaces facing each other in the width direction 51 of the groove 48, and are parallel to each other. The rib 48 is used to block or attenuate light advancing in the width direction 51, and may be detected by the optical sensor 116. The dimension of the rib 48 of the first projection 45 protruding from the front wall 40 in the direction (mounting direction 56) away from the rear wall 42 changes depending on the type of the ink cartridge 30. The type of the ink cartridge 30 indicates a difference in the component or the color of ink, a difference in the amount of ink firstly stored in the ink chamber 36, and the like.

The second projection 46 is provided at the lower end of the front wall 40 of the body 31. Accordingly, the second projection 46 is located below the ink supply unit 37. The width of the second projection 46 is equal to the width of the front wall 40. The second projection 46 protrudes from the front wall 40 in the direction (mounting direction 56) away from the rear wall 42. The front end of the second projection 46 protrudes to the front side of the ink supply port 71 as the front end of the ink supply unit 37 in the direction (mounting direction 56) away from the rear wall 42. The dimension of the second projection 46 protruding from the front wall 40 in a direction (mounting direction 56) away from the rear wall 42 changes depending on the type of the ink cartridge 30. The type of the ink cartridge 30 indicates a difference in the component or the color of ink, a difference in the amount of ink firstly stored in the ink chamber 36, and the like. Further, in the embodiment, the second projection 46 is indirectly detected in the cartridge mounting unit 110. However, the rib of the second projection may be directly detected by the optical sensor 117 in such a manner that a rib is provided in the second projection 46 as in the rib 48 of the first projection 45.

A detected piece 49 is formed at the front wall 40 of the body 31 so as to attenuate or block the infrared light advancing in the width direction 51, and the detected piece is provided at the front side of the direction (mounting direction 56) away from the rear wall 42 of the remaining amount detecting unit 33 between the first projection 45 and the second projection 46 in the height direction 52. The width of the detected piece 49 is substantially equal to the width of the remaining amount detecting unit 33 in the width direction 51. This width is a dimension in which the detected piece may move between the light emitting element 118 and the light receiving element 119 (refer to FIG. 5) of the optical sensor 114. Further, the detected piece 49 may be formed as a part of the remaining amount detecting unit 33, and be formed of a transmissive resin. In this case, the detected piece 49 has a thickness in the width direction 51 so that the infrared light may be attenuated. Further, the transmissive resin may have a thickness that attenuates or reflects the infrared light or may contain a colored agent.

The detected piece 49 and the remaining amount detecting unit 33 are disposed so as to be away from each other by a predetermined gap in the depth direction 53. This gap allows the infrared light advancing in the width direction 51 to pass therebetween without attenuation less than a predetermined amount. The dimension of the detected piece 49 in the depth direction 53 changes depending on the type of the ink cartridge 30. The type of the ink cartridge 30 indicates a difference in the color of ink, a difference in the component such as pigment or dye, a difference in the amount of ink firstly stored in the ink chamber 36, and the like.

All of the first projection 45, the second projection 46, and the detected piece 49 protrude more than the remaining amount detecting unit 33 in the direction (mounting direction 56) away from the rear wall 42. That is, in the ink cartridge 30, the first projection 45, the second projection 46, and the detected piece 49 are disposed at the front side in the mounting direction 56 in relation to the remaining amount detecting unit 33, and the remaining amount detecting unit 33 is disposed to be close to the rear wall 42 (the rear side of the mounting direction 56) in relation to the first projection 45, the second projection 46, and the detected piece 49. Both of the remaining amount detecting unit 33 and the ink supply port 71 are disposed between the first projection 45 and the second projection 46 in the height direction 52.

As shown in FIG. 4, a guide portion 35 is formed at the upper wall 39 of the body 31 so as to extend in the depth direction 53. The guide portion 35 is formed by a rib or a protrusion projecting upward from the upper wall 39. The distance between the pair of side walls facing each other in the width direction 51 of the guide portion 35 is shorter than the distance between the pair of side walls facing each other in the width direction 51 of the body 31. That is, the dimension of the width direction 51 of the guide portion 35 is smaller than the dimension of the width direction 51 of the body 31.

The lower wall 41 of the body 31 is provided with a guide portion 44 which extends in the depth direction 53. The guide portion 44 is formed by a rib or a projection that protrudes downward from the lower wall 41. The distance between the pair of side walls facing each other in the width direction 51 of the guide portion 44 is shorter than the distance between the pair of side walls facing each other in the width direction 51 of the body 31. That is, the dimension of the width direction 51 of the guide portion 44 is smaller than the dimension of the width direction 51 of the body 31. The guide portions 35 and 44 are adapted to move while being inserted into a guide groove 109 to be described later when the ink cartridge 30 is inserted into or extracted from the cartridge mounting unit 110.

[Ink Supply Device 100]

As shown in FIG. 2, the ink supply device 100 is provided in the printer unit 11. The ink supply device 100 is used to supply ink to the printhead 21 provided in the printer unit 11. The ink supply device 100 includes the cartridge mounting unit 110 on which the ink cartridge 30 may be mounted. Further, FIG. 2 shows a state where the ink cartridge 30 is mounted on the cartridge mounting unit 110.

[Cartridge Mounting Unit 110]

Figure 6:
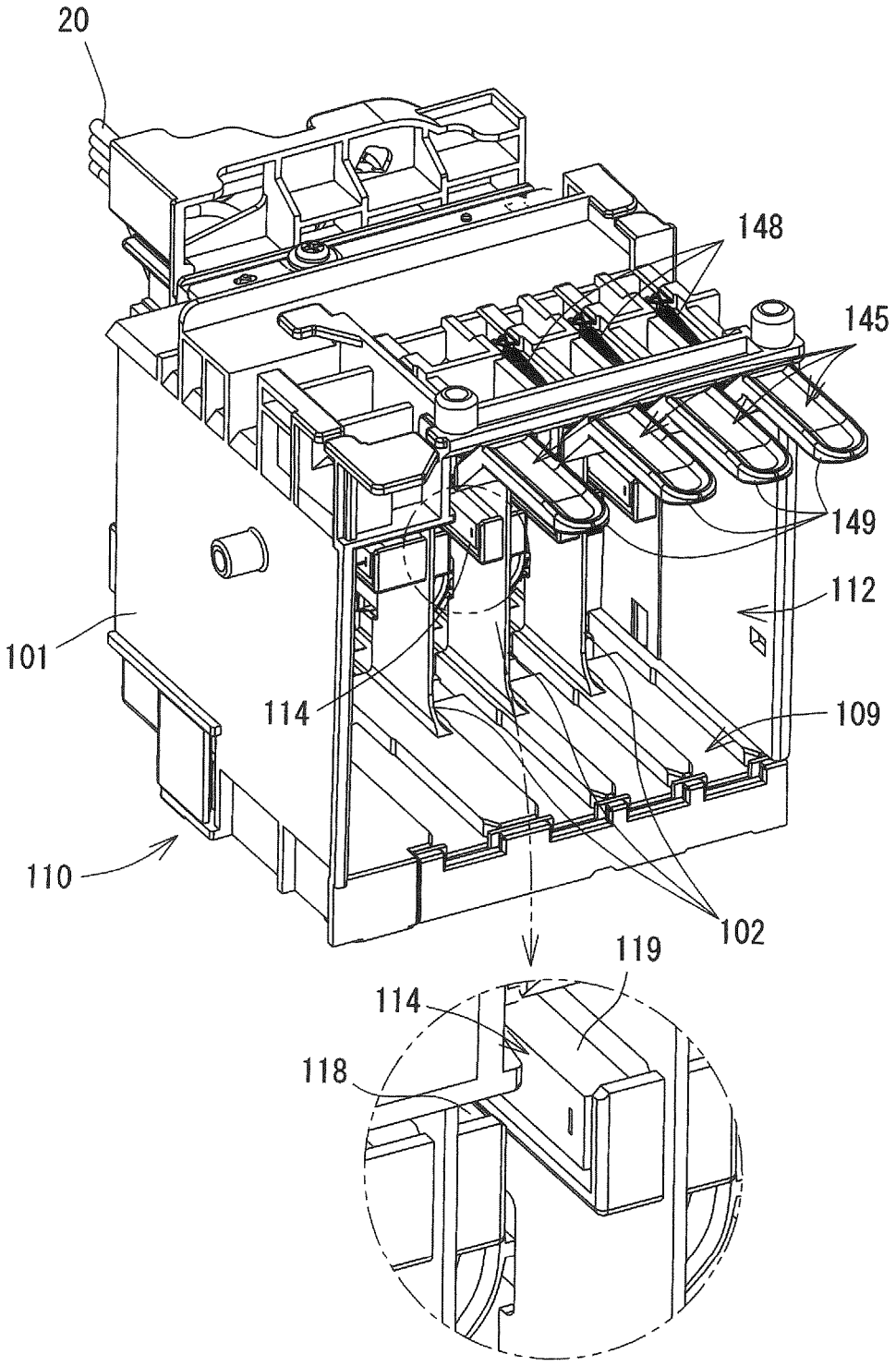
FIG. 6 is a perspective view illustrating a configuration of a cartridge mounting unit.
Figure 7:
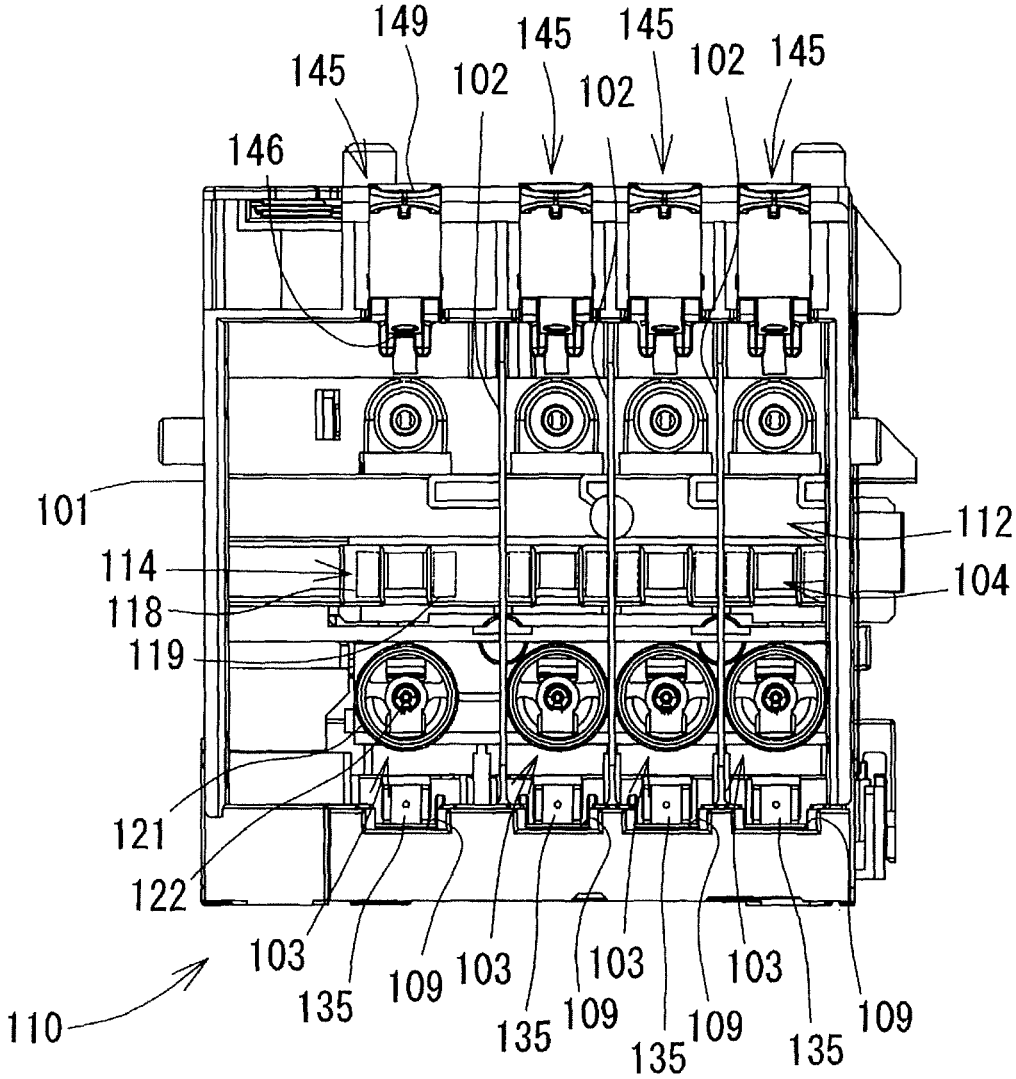
FIG. 7 is a front view illustrating the cartridge mounting unit.

As shown in FIGS. 6 and 7, a case 101 forming a housing of the cartridge mounting unit 110 includes an opening 112 which is formed at the front side of the printer unit 11. The ink cartridge 30 is inserted into or extracted from the case 101 via the opening 112. The ink cartridge 30 is guided in the inserting/extracting direction 50 when the guide portion 35 is inserted into a guide groove 109 provided in the ceiling surface defining the ceiling portion of the internal space of the case 101, and the guide portion 44 is inserted into a guide groove 109 provided in the bottom surface defining the bottom portion of the internal space of the case 101. The case 101 may accommodate four ink cartridges 30 respectively corresponding to the colors of cyan, magenta, yellow, and black.

The case 101 is provided with three plates 102 that define and divide the internal space into four spaces in the lengthwise direction. Each of the spaces defined and divided by the plates 102 accommodates the ink cartridge 30. The plate 102 is provided at the end surface side which is the opposite side of the opening 112 in the case 101.

As shown in FIG. 7, a connected portion 103 is provided at the lower portion of the end surface of the case 101. Each connected portion 103 is disposed at a position corresponding to the ink supply unit 37 of each ink cartridge 30 mounted on the case 101 in the end surface. In the embodiment, four connected portions 103 are provided so as to correspond to four ink cartridges 30 which may be accommodated in the case 101.

The connected portion 103 includes the ink needle 122 and a holding portion 121. The ink needle 122 is formed as a tubular resinous needle. The ink needle 122 is connected to the ink tube 20 at the outer surface side that forms the front and rear surfaces with the end surface of the case 101. Each ink tube 20 drawn from each ink needle 122 to the outer surface forming the front and rear surfaces with the end surface of the case 101 is guided upward along the outer surface of the case 101, and is extended to the printhead 21 of the printer unit 11 so as to circulate the ink.

Figure 8:
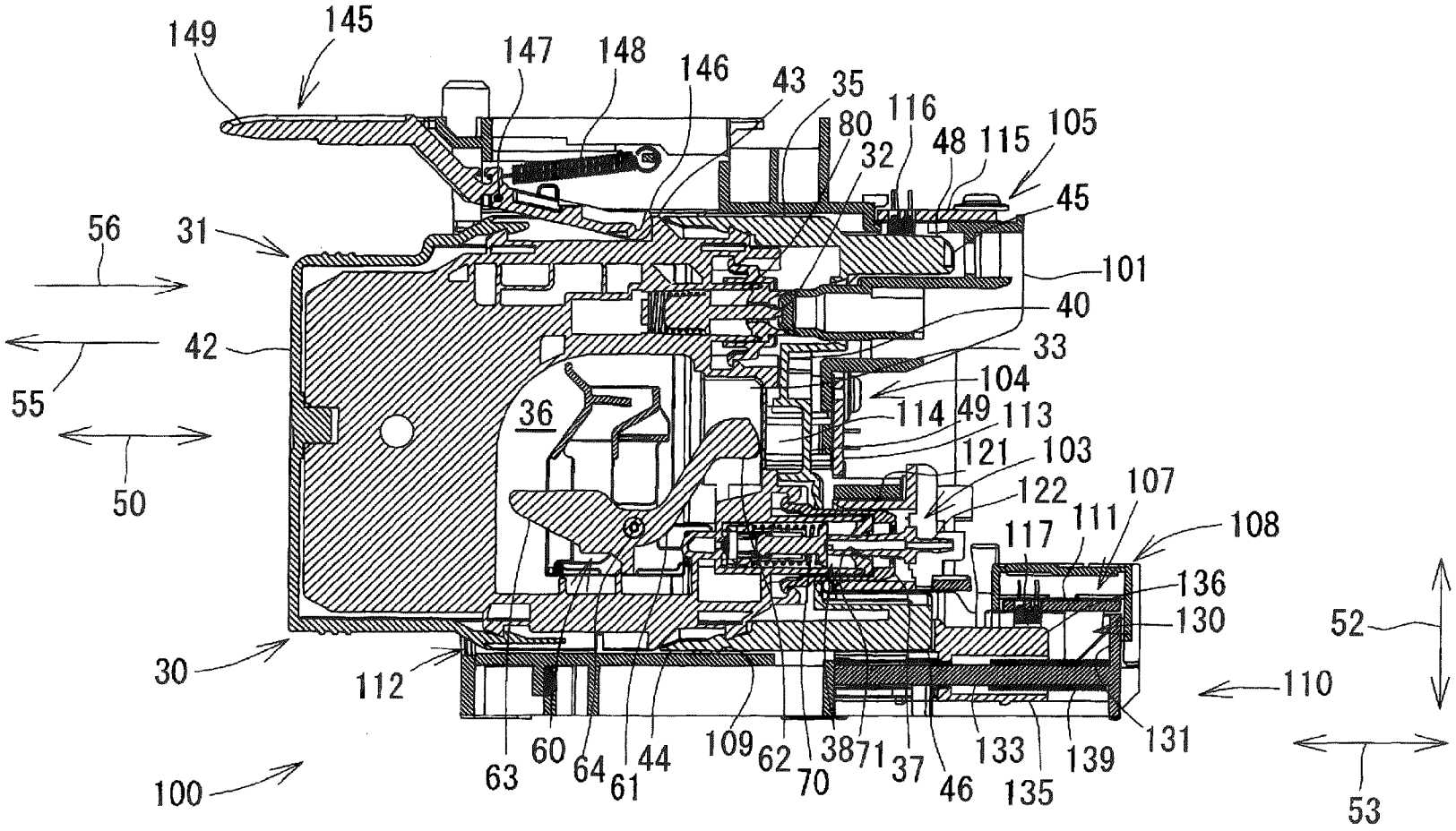
FIG. 8 is a longitudinal sectional view illustrating a state where the ink cartridge is mounted on the cartridge mounting unit.

The holding portion 121 is formed in a cylindrical shape. The ink needle 122 is disposed at the center of the holding portion 121. As shown in FIG. 8, when the ink cartridge 30 is mounted on the cartridge mounting unit 110, the ink supply unit 37 is inserted into the cylindrical portion of the holding portion 121. At this time, the outer peripheral surface of the ink supply unit 37 comes into close contact with the inner peripheral surface of the cylindrical portion of the holding portion 121. Accordingly, the ink supply unit 37 is inserted into the holding portion 121 with a predetermined gap therebetween. When the ink supply unit 37 is inserted into the holding portion 121, the ink needle 122 is inserted into the ink supply port 71 of the ink supply unit 37. Accordingly, the ink stored in the ink chamber 36 may flow outward. The ink flowing outward from the ink chamber 36 flows into the ink needle 122.

As shown in FIGS. 7 and 8, a sensor unit 104 is provided at the upper position in the direction of gravity in relation to the connected portion 103 in the end surface of the case 101. The sensor unit 104 includes a substrate 113 and an optical sensor 114. The sensor unit 104 is formed by mounting the optical sensor 114 on the substrate 113. The sensor unit 104 is provided with four optical sensors 114. The four optical sensors 114 correspond to four ink cartridges 30 that may be accommodated in the case 101. The four optical sensors 114 are disposed in a row in the width direction (same as the width direction 51) of the case 101 between the plates 102.

Each optical sensor 114 includes the light emitting element 118 such as an LED and the light receiving element 119 such as a photo resistor. Each of the light emitting element 118 and the light receiving element 119 is surrounded by a housing. The external shape of the optical sensor 114 is a horseshoe shape formed by the housing. The light emitting element 118 may emit light from the housing in one direction. The light receiving element may receive the light emitted to the housing from one direction. The light emitting element 118 and the light receiving element 119 are disposed to face each other with a predetermined gap therebetween in the horseshoe-shaped housing. A space between the light emitting element 118 and the light receiving element 119 is formed so that the remaining amount detecting unit 33 and the detected piece 49 of the ink cartridge 30 may move therein. When the remaining amount detecting unit 33 or the detected piece 49 enters the optical path of the optical sensor 114, the optical sensor 114 may detect a variation in the light transmission amount due to the remaining amount detecting unit 33 or the detected piece 49. The optical sensor 114 is an example of a sensor.

As shown in FIG. 8, a sensor unit 105 is provided at the end surface side of the ceiling surface of the case 101. The sensor unit 105 includes a substrate 115 and the optical sensor 116. The sensor unit 105 is formed by mounting the optical sensor 116 on the substrate 115. The sensor unit 105 is provided with four optical sensors 116. The four optical sensors 116 correspond to four ink cartridges 30 that may be accommodated in the case 101. The four optical sensors 116 are disposed in a row in the width direction (aligned with the width direction 51) of the case 101 between the plates 102.

When the ink cartridge 30 is mounted on the case 101, the rib 48 of the first projection 45 enters the optical path of the optical sensor 116. When a variation in the signal of the optical sensor 116 at this time is detected, the mounting state of the ink cartridge 30 may be determined. Since the optical sensor 116 includes the light emitting element and the light receiving element as in the optical sensor 114, the detailed description of the optical sensor 116 will not be repeated herein.

As shown in FIG. 7, a slide member 135 is disposed in a space 130 formed at the lower end side of the end surface of the cartridge mounting unit 110. In the embodiment, four slide members 135 are provided so as to correspond to four ink cartridges 30 that may be accommodated in the case 101. The space 130 is continuous to the internal space of the cartridge mounting unit 110. The slide member 135 is supported by a support rod 133 extending in the inserting/extracting direction 50 of the space 130 so as to be slidable in the inserting/extracting direction 50. The external shape of the slide member 135 is formed in a substantially rectangular parallelepiped shape. A rib 136 is provided at the upper end of the slide member 135 so as to extend in the inserting/extracting direction 50. The slide member 135 is disposed in the insertion path of the second projection 46 of the ink cartridge 30, and may come into contact with the second projection 46.

The space 130 is provided with a coil spring 139. The coil spring 139 elastically biases the slide member 135 toward the opening 112, that is, elastically biases the ink cartridge 30 toward the opening 112, that is, toward a direction in which the ink cartridge 30 is extracted from the cartridge mounting unit 110. The coil spring 139 is fitted to the outside of the support rod 133 extending in the inserting/extracting direction 50 in the space 130, and is interposed between the slide member 135 and the end wall 131 defining the terminal end of the space 130. When the coil spring 139 has a natural length, that is, an external force is not applied to the slide member 135, the slide member 135 is disposed at a predetermined first position (refer to FIG. 10) on the side of the opening 112. When the ink cartridge 30 is inserted into the cartridge mounting unit 110, the second projection 46 of the ink cartridge 30 comes into contact with the slide member 135, and the slide member 135 is pressed toward the end wall 131 of the space 130. Accordingly, the coil spring 139 is contracted, and the slide member 135 is slid to the second position (refer to FIG. 8) at the side of the end wall 131. The contracted coil spring 139 biases the ink cartridge 30 in the extracting direction 55 via the slide member 135.

As shown in FIG. 8, a sensor unit 107 is provided at the lower side of the direction of gravity in relation to the connected portion 103, and the upper side of the direction of gravity in relation to the slide member 135 in the end surface of the case 101. The sensor unit 104 includes a substrate 111 and the optical sensor 117. The sensor unit 107 is formed by mounting the optical sensor 117 on the substrate 111. The sensor unit 107 is provided with four optical sensors 117. The four optical sensors 117 correspond to four ink cartridges 30 that may be accommodated in the case 101. In other words, the four optical sensors 117 correspond to the four slide members 135. The four optical sensors 117 are disposed in a row in the width direction (aligned with the width direction 51) of the case 101 at the upper side of the space 130.

When the ink cartridge 30 is mounted on the case 101, the slide member 135 is slid toward the end wall 131 of the space 130, and the rib 136 enters the optical path (detection position) of the optical sensor 117, so that the movement of the rib may be detected by the optical sensor 117. Since the optical sensor 117 includes the light emitting element and the light receiving element as in the optical sensor 114, the detailed description of the optical sensor 117 will not be repeated herein.

In the cartridge mounting unit 110, the detection position of the optical sensor 114 is disposed at the rear side of the mounting direction 56 in relation to the detection positions of the optical sensors 116 and 117.

The case 101 is provided with the lock lever 145. The lock lever 145 is used to maintain the mounting state of the ink cartridge 30 mounted on the cartridge mounting unit 110 while resisting the biasing force of the coil spring 139. The lock lever 145 is disposed at the upper side of the opening 112 of the case 101. In the embodiment, four lock levers 145 are provided so as to correspond to four ink cartridges 30 that may be mounted on the case 101.

The entire lock lever 145 is formed in an arm shape. A support shaft 147 is provided around the center of the lock lever 145. The support shaft 147 is supported by the case 101. Accordingly, the lock lever 145 is supported at the upper side of the opening 112 of the case 101 so as to be rotatable about the support shaft 147. The lock lever 145 is largely divided into an operation portion 149 and an engagement portion 146. The operation portion 149 protrudes outward from the opening 112 of the case 101. The operation portion 149 is a portion that receives an operation of rotating the lock lever 145. The engagement portion 146 enters into the case 101. The engagement portion 146 may engage with the engaged portion 43 of the ink cartridge 30. When the engagement portion 146 engages with the engaged portion 43, the ink cartridge 30 biased by the coil spring 139 is maintained to be mounted on the case 101. The rotation position (refer to FIG. 8) of the lock lever 145 where the engagement portion 146 may engage with the engaged portion 43 is referred to as a lock position, and the position (refer to FIG. 10) where the engagement portion 146 does not engage with the engaged portion 43 is referred to as an unlock position.

The lock lever 145 is attached with a coil spring 148. The lock lever 145 is urged toward the lock position by the coil spring 148. When the operation portion 149 is pressed downward in the direction of gravity in the lock lever 145 located at the lock position, the lock lever 145 rotates from the lock position to the unlock position.

[Control Unit 90]

Figure 9:
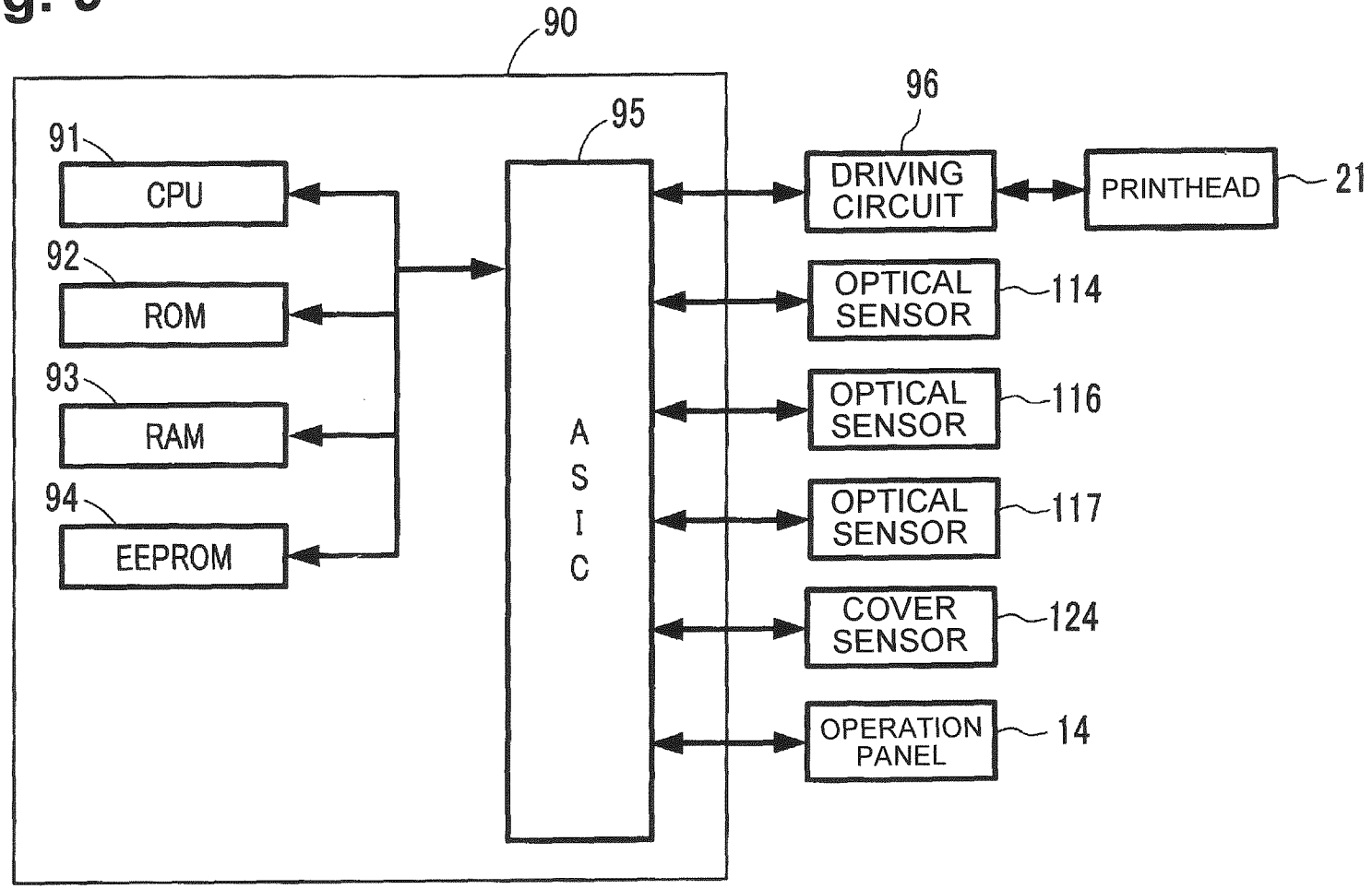
FIG. 9 is a block diagram illustrating a configuration of a control unit.

Hereinafter, the schematic configuration of a control unit 90 will be described by referring to FIG. 9.

The control unit 90 controls the entire operation of the printer unit 11. The control unit 90 is configured as a microcomputer mainly including a CPU 91, a ROM 92, a RAM 93, an EEPROM 94, and an ASIC 95. The control unit 90 serves as the counter, the ink remaining amount determining section, the first storage section, the second storage section, the first reset section, the second reset section, the third reset section, the temporary count holding section, the operation detecting section, the first comparison section, and the power detecting section.

The ROM 92 stores a program allowing the CPU 91 to control various operations of the printer unit 11 or a program executing a determination process to be described later, or the like. The RAM 93 is used as a storage area that temporarily stores signals or data used to execute the program by the CPU 91 or a working area of a data process. The EEPROM 94 stores a setting, a flag, and the like to be maintained even after turning off power. For example, a count integrated value using a dot counter or a state of the remaining amount of ink in accordance with the precedent trigger signal is stored in the EEPROM 94.

The ASIC 95 is connected to optical sensors 114, 116, and 117. Further, the ASIC is connected to a driving circuit 96 driving the printhead 21 or the operation panel 114 used to input an image printing command and the like to the printer unit 11 or to display information on the printer unit 11. Further, although not shown in FIG. 9, the ASIC is connected to a driving circuit driving rollers such as the paper feeding roller 23 or the pair of transportation rollers 25.

The optical sensors 114, 116, and 117 output analog electric signals (voltage signals or current signals) in accordance with the intensity of the light received by the light receiving element. The control unit 90 monitors the electric signals output from the optical sensors 114, 116, and 117 at a predetermined timing. The control unit determines that it is a HIGH level signal when the level (the voltage value or the current value) of the electric signal is a predetermined threshold value or more, and determines that it is a LOW level signal when the level is less than a predetermined threshold value. Further, in the embodiment, it is determined that the output signal is the LOW level signal when the light is blocked or attenuated at the detection position of each of the optical sensors 114, 116, and 117, and it is determined that the output signal is the HIGH level signal when the light is not blocked or attenuated. However, since the HIGH level signal or the LOW level signal is relatively determined, the type of the output signal corresponding to the level (threshold value) of the electric signal may be reversed.

The driving circuit 96 selectively ejects respective colors of inks from the printhead 21 to the printing paper at a predetermined timing. The ASIC 95 creates an output signal on the basis of the driving control procedure output from the CPU 91. The driving circuit 96 receives the output signal, and controls the driving of the printhead 21. The control unit 90 counts the number of ink droplets ejected from the printhead 21 on the basis of the output signal to the driving circuit 96. That is, the control unit 90 serves as a dot counter. The control unit 90 stores the integrated values of the number of counted ink droplets as a count integrated value in the EEPROM 94.

[Mounting Operation of Ink Cartridge 30]

Hereinafter, the operation of mounting the ink cartridge 30 on the cartridge mounting unit 110 will be described by referring to FIGS. 10 to 12.

As shown in FIG. 1, the opening 112 of the cartridge mounting unit 110 is closed by the cover 13 which is provided in the housing of the printer unit 11 so as to be opened or closed. When the ink cartridge 30 is mounted, the cover 13 is opened. The opened or closed state of the cover 13 is detected by the cover sensor 124 (refer to FIG. 9). The control unit 90 may detect whether the cover 13 is opened on the basis of the detection signal of the cover sensor 124. The control unit 90 controls the optical sensors 114, 116, and 117 so as to emit light therefrom by using the opened state of the cover 13 as a trigger.

Figure 10:
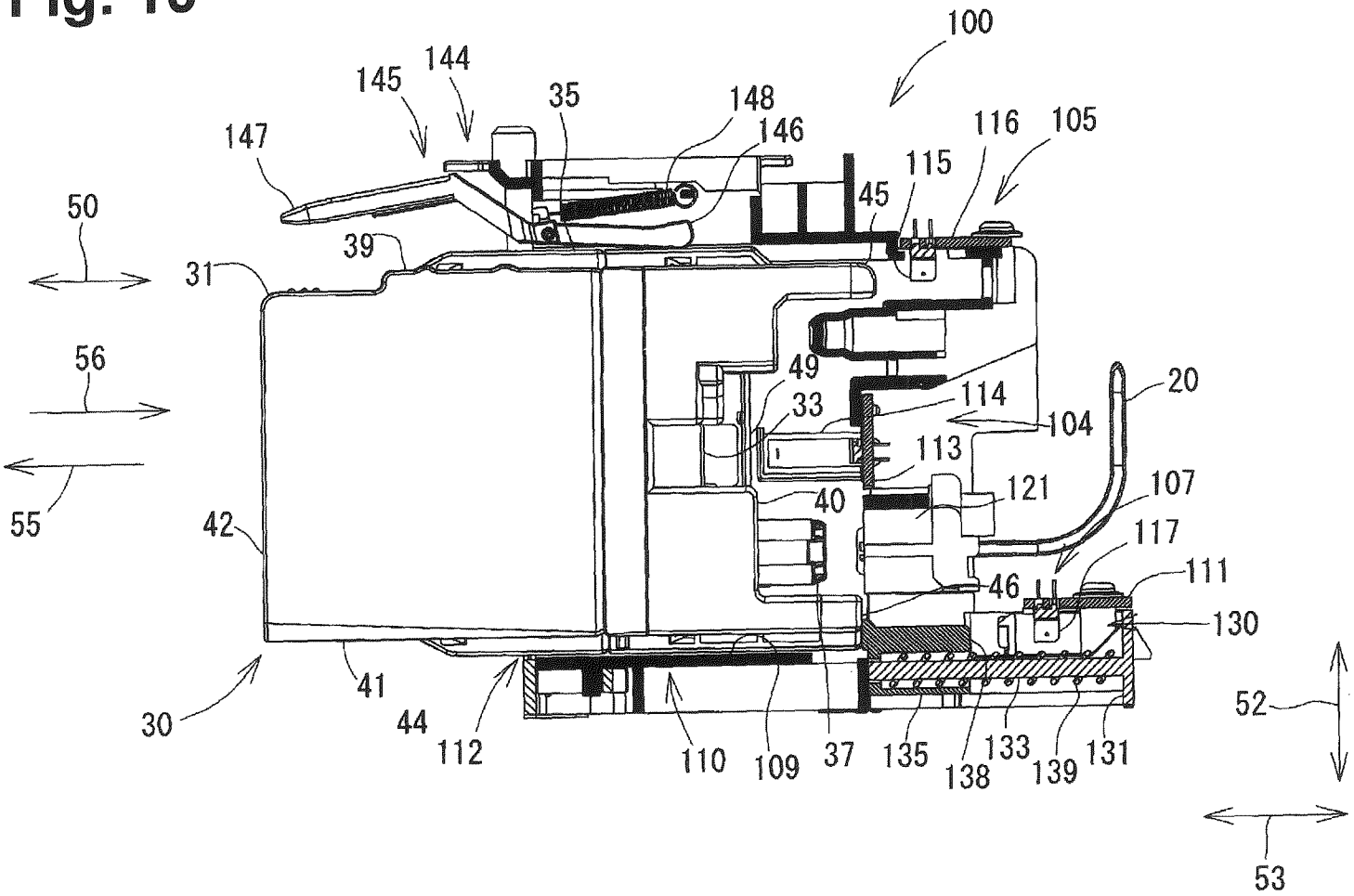
FIG. 10 is a cross-sectional view illustrating the cartridge mounting unit immediately after the ink cartridge is inserted into the cartridge mounting unit.

As shown in FIG. 10, when the ink cartridge 30 is inserted into the cartridge mounting unit 110 in the mounting direction 56, a guide surface formed at the front end of the guide portion 35 in the mounting direction 56 so as to be inclined to the front side of the mounting direction 56 first comes into contact with the engagement portion 146 of the lock lever 145. Further, when the ink cartridge 30 is inserted into the cartridge mounting unit 110, the engagement portion 146 of the lock lever 145 ascends on the guide portion 35. Accordingly, the lock lever 145 rotates in the counter-clockwise direction of FIG. 10 so as to move from the lock position to the unlock position.

Figure 11:
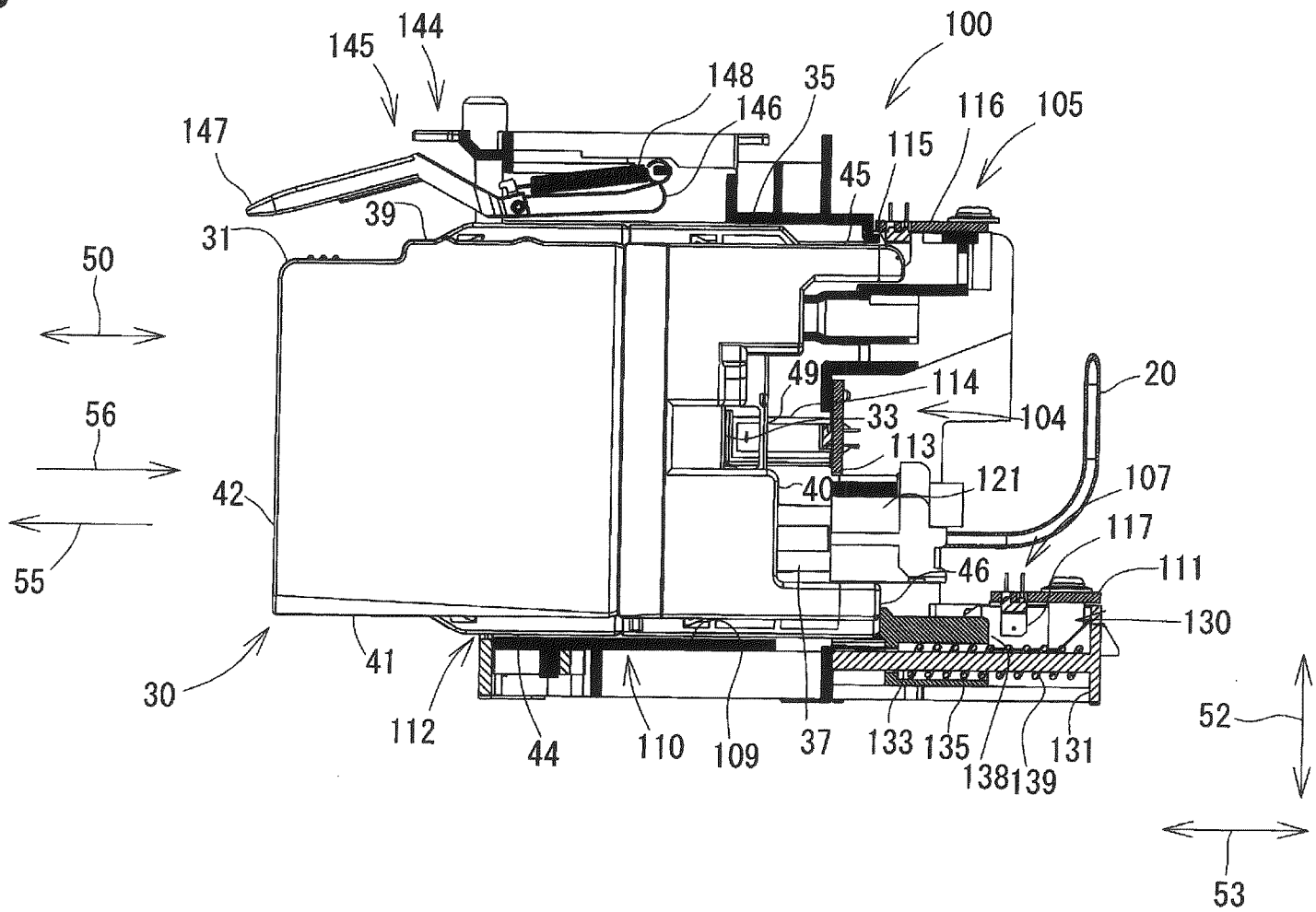
FIG. 11 is a cross-sectional view illustrating the cartridge mounting unit when a rib of a first projection is detected after the ink cartridge is inserted into the cartridge mounting unit.

Further, when the ink cartridge 30 is inserted into the cartridge mounting unit 110, the detected piece 49 passes through the detection position of the optical sensor 114 as shown in FIG. 11. At this time, the remaining amount detecting unit 33 does not reach the detection position of the optical sensor 114. The output signal of the optical sensor 114 changes from the HIGH level signal to the LOW level signal, and again changes to the HIGH level signal before the remaining amount detecting unit 33 reaches the detection position of the optical sensor 114 after the optical sensor 114 detects the detected piece 49. Since the control unit 90 monitors a variation in the output signal of the optical sensor 114, the control unit stores a flag informing that the detected piece 49 is detected on the basis of the condition that the output signal of the optical sensor 114 changes from the LOW level signal to the HIGH level signal.

Further, when the ink cartridge 30 is inserted into the cartridge mounting unit 110, the rib 48 of the first projection 45 enters the detection position of the optical sensor 116 as shown in FIG. 11. When the optical sensor 116 detects the rib 48, the output signal of the optical sensor 116 changes from the HIGH level signal to the LOW level signal. Since the control unit 90 monitors a variation in the output signal of the optical sensor 116, the control unit detects the rib 48 of the first projection 45 on the basis of the fact that the output signal is the LOW signal.

The control unit 90 generates a trigger signal on the basis of the condition that the output signal of the optical sensor 116 changes from the HIGH level signal to the LOW level signal. The control unit determines the output signal of the optical sensors 114 and 117 in response to the trigger signal.

While the ink cartridge 30 is mounted on the cartridge mounting unit 110, the second projection 46 comes into contact with the slide member 135. When the ink cartridge 30 is further inserted into the cartridge mounting unit 110, the slide member located at the first position (refer to FIG. 10) is pressed toward the second position, that is, the end wall 131 of the space 130 while resisting the biasing force of the coil spring 139. Accordingly, the rib 136 of the slide member 135 moves close to the detection position of the optical sensor 117.

As shown in FIG. 11, in the ink cartridge 30, the rib 136 of the slide member 135 does not reach the detection position of the optical sensor 117 when the output signal of the optical sensor 116 changes from the HIGH level signal to the LOW level signal, that is, a trigger signal is generated. Accordingly, the output signal of the optical sensor 117 is the HIGH level signal.

The control unit 90 stores the output signals of the optical sensors 114 and 117 at the time when the output signal of the optical sensor 116 changes from the HIGH level signal to the LOW level signal.

Figure 12:
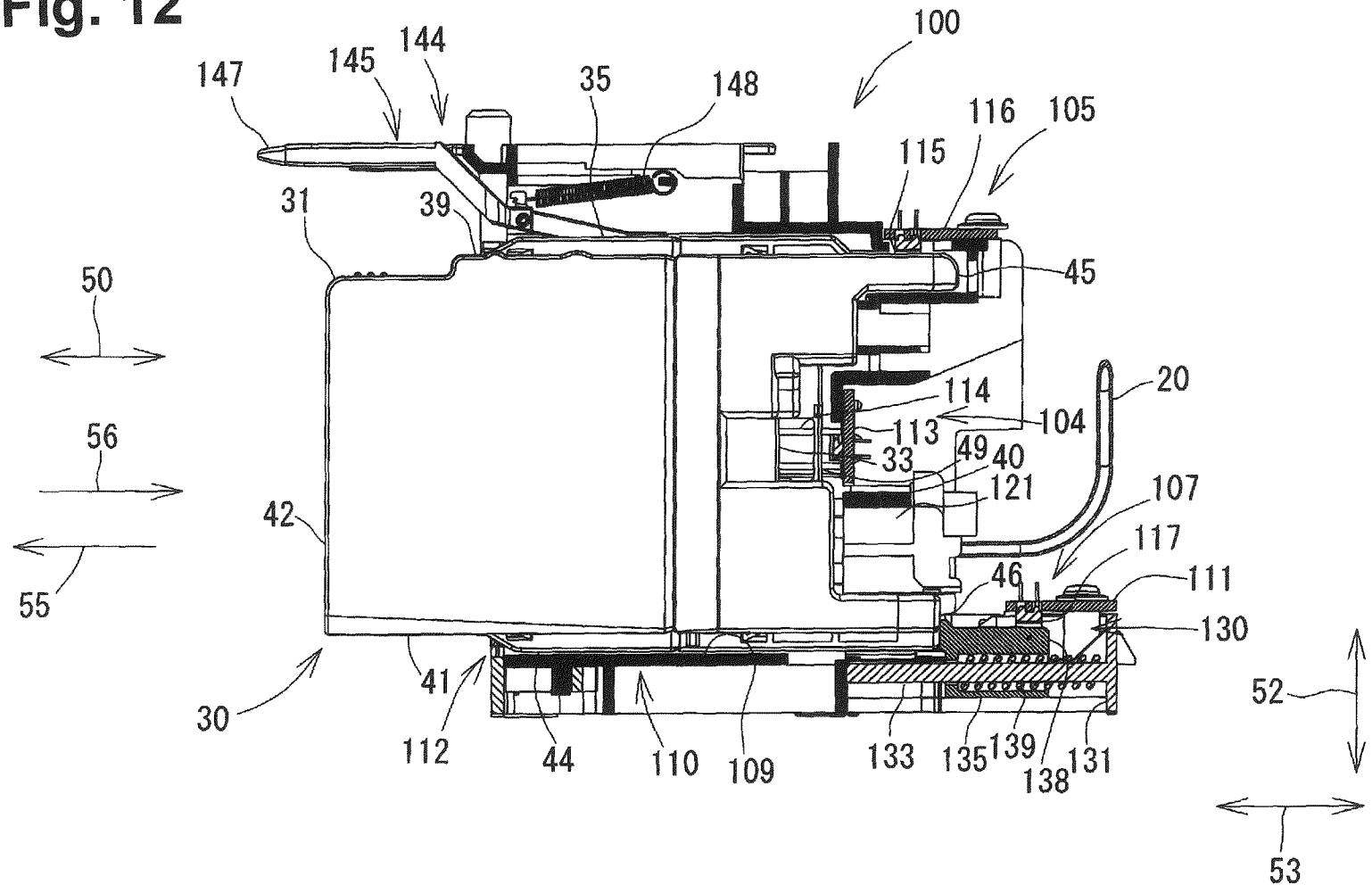
FIG. 12 is a cross-sectional view illustrating the cartridge mounting unit when a rib of a slide member is detected after the ink cartridge is inserted into the cartridge mounting unit.

As shown in FIG. 12, when the ink cartridge 30 is further inserted into the cartridge mounting unit 110, the rib 136 of the slide member 135 reaches the detection position of the optical sensor 117. Accordingly, the output signal of the optical sensor 117 changes from the HIGH level signal to the LOW level signal. The control unit 90 detects the rib 136 of the slide member 135 on the basis of the fact that the output signal of the optical sensor 117 is the LOW level signal.

As shown in FIG. 12, when the ink cartridge 30 is further inserted into the cartridge mounting unit 110 so that the ink cartridge 30 reaches the mounting position of the cartridge mounting unit 110, the remaining amount detecting unit 33 reaches the detection position of the optical sensor 114. Further, the ink needle 122 is inserted into the ink supply port 71 of the ink supply unit 37, so that the ink supply port 71 is opened. In this mounting state, ink stored in the ink chamber 33 may be supplied to the ink tube 20 via the ink needle 122.

When the ink cartridge 30 reaches the mounting position, the engaged portion 43 passes the engagement portion 146 of the lock lever 145 in the mounting direction 56. Accordingly, since the engagement portion 146 of the lock lever 145 is not supported by the guide portion 35, the lock lever 145 rotates in the clockwise direction in FIG. 12, and the engagement portion 146 engages with the engaged portion 43. Due to the engagement between the engagement portion 146 and the engaged portion 43, the ink cartridge 30 is mounted at the mounting position while resisting the biasing force applied from the slide member 135 in the extracting direction 55. Accordingly, the ink cartridge 30 is completely mounted on the cartridge mounting unit 110.

Further, when the ink cartridge 30 reaches the mounting position, all of the rib 138 of the slide member 135, the remaining amount detecting unit 33, and the rib 48 of the first projection 45 of the ink cartridge 30 enter the detection positions of the optical sensors 114, 116, and 117. Accordingly, when the sensor arm 60 takes the lower position attitude, all output signals of the optical sensors 114, 116, and 117 become the LOW level signals.

The control unit 90 determines the type of the ink cartridge 30 on the basis of the condition that the rib 48 of the first projection 45 and the rib 139 of the slide member 135 are detected, that is, both of the output signals of the optical sensors 116 and 117 are the LOW signals. The determination of the type is performed on the basis of the presence of the flag generated when the output signal of the optical sensor 116 changes from the HIGH level signal to the LOW level signal and the output signal of the optical sensor 117. However, the detailed description thereof will be omitted herein.

[Remaining Amount Determination of Ink Cartridge 30]

Hereinafter, the remaining amount determination of the ink cartridge 30 will be described.

As shown in FIG. 8, when light is emitted from the light emitting element 118 of the optical sensor 114 while the ink cartridge 30 is mounted on the cartridge mounting unit 110, the light is emitted to the remaining amount detecting unit 33. In the state where a predetermined amount or more of ink is filled in the ink chamber 36, the light emitted to the remaining amount detecting unit 33 is blocked by the indicator portion 62 of the sensor arm 60. When the ink of the ink chamber 36 is less than a predetermined amount, the sensor arm 60 rotates, and the light emitted to the remaining amount detecting unit 33 is not blocked by the indicator portion 62 of the sensor arm 60. That is, the attitude of the sensor arm 60 changes in accordance with the amount of ink stored in the ink chamber 36, and the light transmission state of the remaining amount detecting unit 33 changes in accordance with a variation in the attitude of the sensor arm 60. The light receiving amount of the light receiving element 119 becomes different in accordance with whether the light emitted from the light emitting element 118 is blocked by the indicator portion 62. Due to the difference, the light receiving element 119 outputs different electric signals. That is, when the light emitted to the remaining amount detecting unit 33 is blocked by the indicator portion 62 of the sensor arm 60, the optical sensor 114 outputs the LOW level signal. When the light emitted to the remaining amount detecting unit 33 is not blocked by the indicator portion 62 of the sensor arm 60, the optical sensor 114 outputs the HIGH level signal.

The control unit 90 determines whether the ink inside the ink chamber 102 is less than a predetermined amount in accordance with a difference in the electric signal output from the optical sensor 114. When the light emitted to the remaining amount detecting unit 33 is blocked by the indicator portion 62 of the sensor arm 60, so that the optical sensor 114 outputs the LOW level signal, the control unit 90 determines that the remaining amount of ink is full. The full state corresponds to the second state in this embodiment. When the light emitted to the remaining amount detecting unit 33 is not blocked by the indicator portion 62 of the sensor arm 60, so that the optical sensor 114 outputs the HIGH level signal, the control unit 90 determines that the remaining amount of ink is near empty. The near empty state corresponds to the first state in this embodiment. The control unit 90 determines that the remaining amount of ink is empty when the count integrated value is more than a predetermined threshold value on the basis of the count integrated value after the remaining amount of ink changes from the full state to the near empty state. The empty state corresponds to the third state in this embodiment. The threshold value used to determine the empty state is set as the number of ink droplets for consuming the amount of ink rotating the sensor arm 60 in the ink cartridge 30 in advance.

The control unit 90 displays the result of the determination of the remaining amount of ink on the operation panel 14. That is, the determination result for each of four ink cartridges 30 is displayed as the full state, the near empty state, and the empty state. The display may be performed by a character or an image. The image is depicted by, for example, a figure such as a bar graph in the height direction corresponding to the amount of ink. Further, the control unit 90 transmits the result of the determination of the remaining amount of ink to an external information device such as a PC connected to the multi-functional apparatus 10, and the external information device receiving the result displays the determination result on a display or the like on the basis of a printer driver.

The control unit 90 determines the remaining amount of ink of the ink cartridge 30 by using a signal as a trigger other than the output signals of the optical sensors 114, 116, and 117 generated when the ink cartridge 30 is mounted. Further, the control unit 90 performs the determination of the remaining amount of ink on the basis of the condition that the rib 48 of the first projection 45 and the rib 138 of the slide member 135 are detected by the optical sensors 116 and 117. Whether the optical sensors 116 and 117 detect the rib 48 of the first projection 45 and the rib 138 of the slide member 135 may be determined when the trigger is generated.

The trigger signal for determining the remaining amount of ink of the ink cartridge 30 is generated, for example, when the cover 13 is closed on the basis of the output signal of the cover sensor 124, an image printing operation for one page is completed, a cleaning operation of the printhead 21 using the cleaning mechanism 81 is completed, the multi-functional apparatus 10 is turned on, the socket of the multi-functional apparatus 10 is connected, the printer unit 11 returns from the sleep state to the operation state, and the like. The determination result based on the trigger signal is rewritten and stored in the EEPROM 94 of the control unit 90.

[Exchange Determination of Ink Cartridge 30]

Hereinafter, the exchange determination method of the ink cartridge 30 will be described. When the ink of the ink cartridge 30 is consumed, so that no ink exists in the ink chamber 36, the ink cartridge 30 of which the ink is used up is extracted from the cartridge mounting unit 110, and a new ink cartridge 30 having the ink chamber 36 filled with ink is inserted into the cartridge mounting unit 110.

In general, the ink cartridge 30 is exchanged when the ink of the ink chamber 36 is consumed, the control unit 90 determines that is the near empty state as a remaining amount determination result based on the output of the optical sensor 114, the control unit 90 determines that is the empty state on the basis of the count integrated value after the near empty state, and the determination result is displayed on the operation panel 14 or the like. However, the ink cartridge 30 may be exchanged at the near empty state before the empty state. Further, the ink cartridge 30 may not be necessarily exchanged. For example, the ink cartridge 30 may be extracted from the cartridge mounting unit 110 by the user so as to check the remaining amount of ink in the near empty state, and the ink cartridge 30 may be mounted thereon again.

The user opens the cover 13 when exchanging the ink cartridge 30 or remounting the ink cartridge 30. The opened state of the cover 13 is detected by the cover sensor 124. Then, the user mounts a new ink cartridge 30 on the cartridge mounting unit 110, or remounts the ink cartridge 30 that is in use thereon. The inserting/extracting operation of the ink cartridge 30 into or from the cartridge mounting unit 110 is determined by the detection signals of the optical sensors 114, 116, and 117 as described above. When the control unit 90 determines that the ink cartridge 30 is inserted or extracted, the control unit stores a flag informing the inserted/extracted state of the ink cartridge 30 in the RAM 93. Then, the user closes the cover 13. The closed state of the cover 13 is detected by the cover sensor 124.

Figure 13:
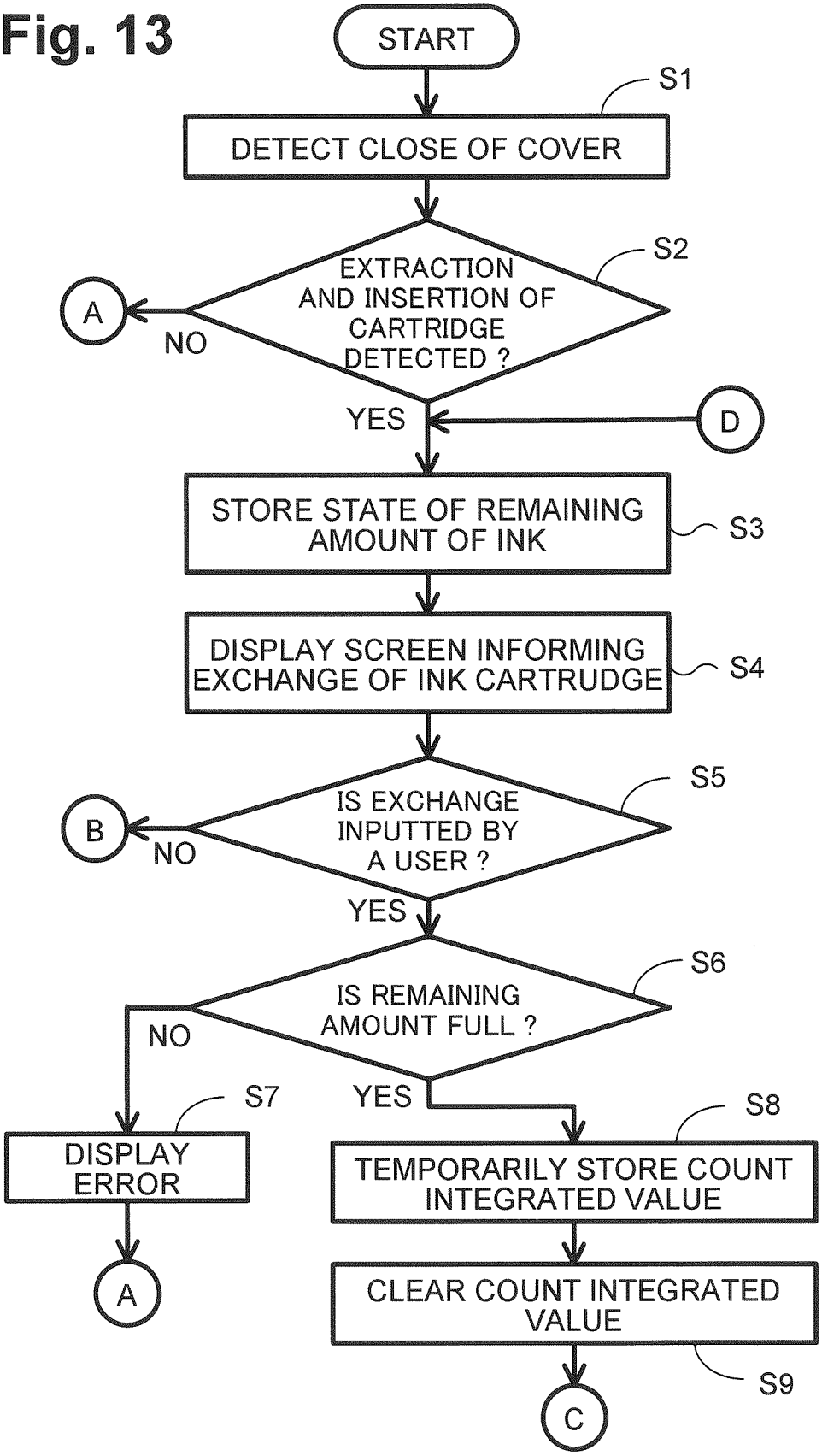
FIG. 13 is a flowchart illustrating an exchange determination process of the ink cartridge.

When the control unit 90 detects that the cover 13 is closed (FIG. 13: S1), the control unit checks whether the flag informing the inserted/extracted state of the ink cartridge 30 is stored in the RAM 93 (FIG. 13: S2). When the ink cartridge 30 is not inserted or extracted (FIG. 13: No of S2), the control unit terminates the process without determining the exchange of the ink cartridge. When the ink cartridge 30 is inserted or extracted (FIG. 13: Yes of S2), the control unit 90 stores the state of the remaining amount of ink just before the inserting or extracting operation, that is, any one of the full state, the near empty state, and the empty state in the RAM 93 (FIG. 13: S3). Then, the control unit 90 displays a screen informing the exchange of the ink cartridge on the operation panel 14 (FIG. 13: S4). This screen displays a message asking the user if the ink cartridge 30 is exchanged. The user inputs "YES" when the ink cartridge 30 is exchanged, or inputs "NO" when the ink cartridge is not exchanged (FIG. 13: S5) while seeing this screen.

When the control unit 90 detects that the cover 13 is closed, the control unit generates a trigger signal for detecting the remaining amount of ink. This trigger signal corresponds to the second trigger signal in this embodiment. By using this trigger signal as a trigger, light is emitted from the optical sensor 114 to the remaining amount detecting unit 33 of the ink cartridge 30. As described above, when the light emitted from the optical sensor 114 is blocked by the indicator portion 62 of the sensor arm 60, the control unit determines that it is a state where the remaining amount of ink inside the ink chamber 36 is a predetermined amount or more, that is, the full state. Further, when the light emitted from the optical sensor 114 is not blocked by the indicator portion 62 of the sensor arm 60, the control unit determines that the remaining amount of ink inside the ink chamber 36 is not a predetermined amount or more, that is, the near empty state or the empty state. Alternatively, the control unit 90 can be configured to detect whether the ink cartridge 30 is locked by the lock lever 145 in place of detecting whether the cover 13 is closed.

When the control unit 90 receives the input of "YES" from the user (FIG. 13: Yes of S5), that is, there is an input informing that the ink cartridge 30 is exchanged, but the remaining amount of ink is not full (FIG. 13: No of S6), the control unit determines that the mounting state of the ink cartridge 30 is not complete or a new ink cartridge 30 is not mounted, and displays an error on the operation panel 14 (FIG. 13: S7).

When the control unit 90 receives the input of "YES" from the user (FIG. 13: Yes of S5) and the remaining amount of ink is full (FIG. 13: Yes of S6), the control unit temporarily stores the count integrated value, having been counted after the near empty state and stored in the EEPROM 94, in another area of the EEPROM 94 (FIG. 13: S8). This count integrated value corresponds to the first count value in this embodiment. Then, the control unit clears the count integrated value in the original storage area (FIG. 13: S9). Further, the control unit 90 reads out the state of the remaining amount of ink before the ink cartridge 30 is inserted or extracted, and terminates the determination of the exchange of the ink cartridge when the remaining amount of ink is full (FIG. 14: Yes of S11).

That is, this case is regarded as that in which the ink cartridge 30 having the ink in the full state is inserted or extracted.

Figure 14:
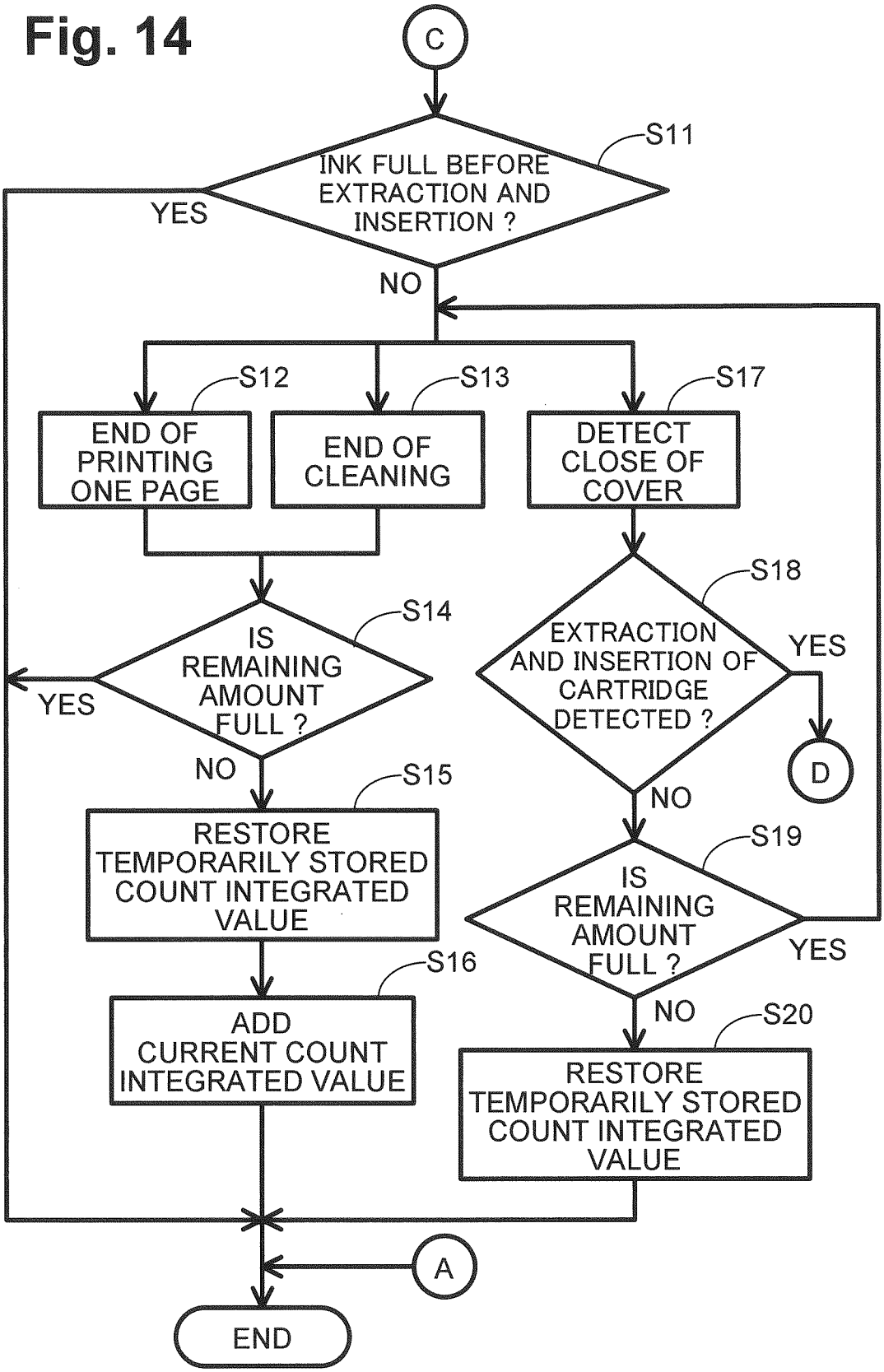
FIG. 14 is a flowchart illustrating the exchange determination process of the ink cartridge.

The control unit 90 reads out the state of the remaining amount of ink before the ink cartridge 30 is inserted or extracted, and performs the re-determination of the exchange of the ink cartridge when the remaining amount of ink is the near empty state or the empty state (FIG. 14: No of S11). The state of the remaining amount of ink before the ink cartridge 30 is inserted or extracted is obtained by using a trigger signal as a trigger generated after a printing operation for one page is completed, a cleaning operation using the cleaning mechanism 81 is completed, or the closed state of the cover 13 is detected. This trigger signal corresponds to the first trigger signal in this embodiment. At this time, since the user inputs that the ink cartridge 30 is exchanged, the detection result of the remaining amount detecting unit 33 after the exchange operation is the full state.

However, a user may erroneously input regarding the exchange operation of the ink cartridge 30. Further, regardless of the state where the ink cartridge 30 having the ink in the near empty state or the empty state is inserted again, ink may be adhered to the inner wall of the remaining amount detecting unit 33 or bubbles may be generated at the boundary surface of the ink of the ink chamber 36, so that a float portion 63 of the sensor arm 60 may be lifted upward in relation to the original position of the boundary surface. In such states, when the remaining amount of ink is detected by the optical sensor 114, the light emitted from the optical sensor 114 is blocked by the remaining amount detecting unit 33, and the detection signal indicating the full state is output regardless of the state where the amount of ink inside the ink chamber 36 is less than a predetermined amount.

The control unit 90 generates a trigger signal used to detect the remaining amount of ink after a printing operation for one page is completed (FIG. 14: S12), a cleaning operation using the cleaning mechanism 81 is completed (FIG. 14: S13), or the closed state of the cover 13 is detected (FIG. 14: S17). This trigger signal corresponds to the third trigger signal.

The control unit 90 emits light from the optical sensor 114 to the remaining amount detecting unit 33 of the ink cartridge 30 after a printing operation for one page is completed (FIG. 14: S12) or a cleaning operation using the cleaning mechanism 81 is completed (FIG. 14: S13). When the light emitted from the optical sensor 114 is blocked by the indicator portion 62 of the sensor arm 60, it is determined that the remaining amount of ink inside the ink chamber 36 is a predetermined amount or more, that is, the full state (FIG. 14: Yes of S14). Then, the control unit 90 terminates the re-determination of the exchange of the ink cartridge. That is, when a time of a printing operation for one page and a cleaning operation is elapsed, ink adhered to the inner wall of the remaining amount detecting unit 33 flows to be dropped therefrom, and the bubbles generated at the boundary surface of the ink of the ink chamber 36 are removed. Accordingly, when the detection signal indicating that the remaining amount of ink is the full state is output from the optical sensor 114 even after the time is elapsed, it is confirmed that the remaining amount of ink inside the ink chamber 36 is a predetermined amount or more.

On the other hand, when the light emitted from the optical sensor 114 is not blocked by the indicator portion 62 of the sensor arm 60, it is determined that the remaining amount of ink inside the ink chamber 36 is not a predetermined amount or more, that is, the near empty state or the empty state (FIG. 14: No of S14). Then, the control unit 90 reads out the temporarily stored count integrated value, and sets the count integrated value as the current count integrated value (FIG. 14: S15). Then, the count value counted during a printing operation for one page or a cleaning operation is added to the temporarily stored count integrated value (FIG. 14: S16). The counted number after the addition corresponds to the second count in this embodiment. Then, the control unit 90 terminates the re-determination of the exchange of the ink cartridge.

The reason why the state of remaining amount of ink is the near empty state or the empty state when the above-described time is elapsed regardless of the state where the ink cartridge 30 is not exchanged is because the light emitted from the optical sensor 114 is temporarily blocked by the remaining amount detecting unit 33 due to the ink adhered to the inner wall of the remaining amount detecting unit 33 or the bubbles generated at the boundary surface of the ink of the ink chamber 36, and the remaining amount of ink inside the ink chamber 36 may not be a predetermined amount or more. At that time, although the user inputs the exchange of the ink cartridge 30, the input is wrong, and the ink cartridge 30 is not exchanged. Accordingly, the current count integrated value is counted on the basis of the count integrated value before the ink cartridge 30 is inserted or extracted.

On the other hand, the control unit 90 detects that the cover 13 is closed (FIG. 14: S17), and reads out the flag informing the inserted/extracted state of the ink cartridge 30. When the ink cartridge 30 is inserted or extracted (FIG. 14: Yes of S18), the control unit stores the state of the remaining amount of ink before the cover 13 is closed in the RAM 93 (FIG. 13: S3), and displays a screen asking the user to exchange the ink cartridge on the operation panel 14 as described above (FIG. 13: S4).

When the ink cartridge 30 is not inserted or extracted (FIG. 14: No of S18), light is emitted from the optical sensor 114 to the remaining amount detecting unit 33 of the ink cartridge 30. When the light emitted from the optical sensor 114 is blocked by the indicator portion 62 of the sensor arm 60, it is determined that the remaining amount of ink inside the ink chamber 36 is a predetermined amount or more, that is, the full state (FIG. 14: Yes of S19). In this case, as described above, the re-determination of the exchange of the ink cartridge is continuously performed in consideration of the influence of the ink adhered to the inner wall of the remaining amount detecting unit 33 or the bubbles generated at the boundary surface of the ink of the ink chamber 36.

On the other hand, when the light emitted from the optical sensor 114 is not blocked by indicator portion 62 of the sensor arm 60, it is determined that the remaining amount of ink inside the ink chamber 36 is not a predetermined amount or more, that is, the near empty state or the empty state (FIG. 14: No of S19). Then, the control unit 90 reads out the temporarily stored count integrated value, and sets the count integrated value as the current count integrated value (FIG. 14: S20). Then, the control unit 90 terminates the re-determination of the exchange of the ink cartridge.

The reason why the state of the remaining amount of ink is the near empty state or the empty state regardless of the state where the ink cartridge 30 is not exchanged is because the light emitted from the optical sensor 114 is temporarily blocked by the remaining amount detecting unit 33 due to the ink adhered to the inner wall of the remaining amount detecting unit 33 or the bubbles generated at the boundary surface of the ink of the ink chamber 36, and the remaining amount of ink inside the ink chamber 36 may not be a predetermined amount or more. At this time, although the user inputs the exchange of the ink cartridge 30, the input is wrong, and the ink cartridge 30 is not exchanged. Accordingly, the count value returns to the count integrated value before the ink cartridge 30 is inserted or extracted.

When the control unit 90 displays a screen informing the exchange of the ink cartridge on the operation panel 14, and the user inputs "NO" (FIG. 13: No of S5), the control unit 90 reads out the state of the remaining amount of ink before the ink cartridge 30 is inserted or extracted. When the state of the remaining amount of ink is the full state or the empty state (FIG. 15: No of S21), the control unit terminates the determination of the exchange of the ink cartridge. This is because the count integrated value after the near empty state is not influenced when the state of the remaining amount of ink is the full state or the empty state. The trigger signal, as a trigger, for determining the state of the remaining amount of ink before the ink cartridge 30 is inserted or extracted corresponds to the first trigger signal in this embodiment.

Figure 15:
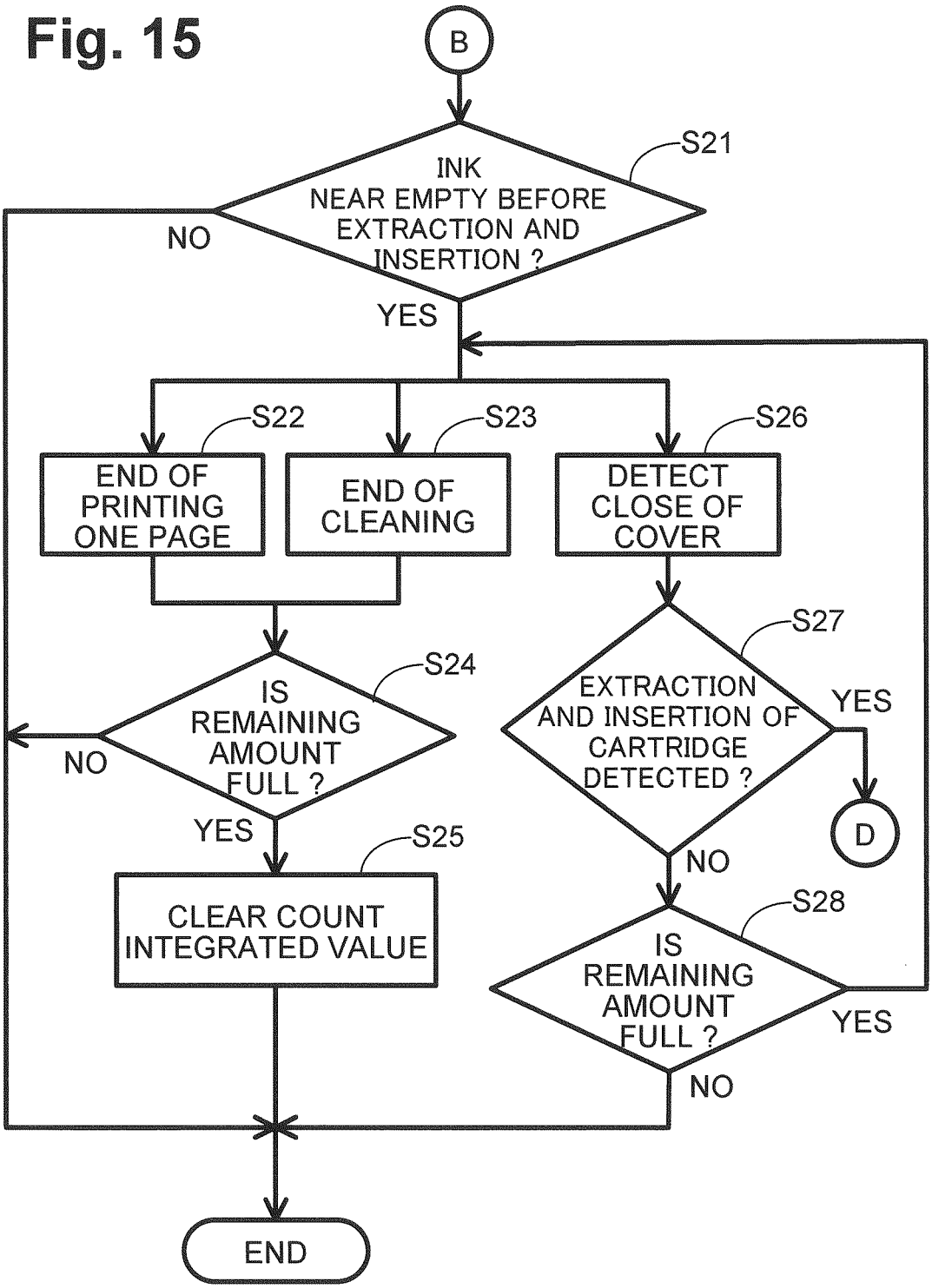
FIG. 15 is a flowchart illustrating the exchange determination process of the ink cartridge.

The control unit 90 reads out the state of the remaining amount of ink before the ink cartridge 30 is inserted or extracted, and performs the re-determination of the exchange of the ink cartridge when the remaining amount of ink is the near empty state (FIG. 15: Yes of S21).

The control unit 90 emits light from the optical sensor 114 to the remaining amount detecting unit 33 of the ink cartridge 30 after a printing operation for one page is completed (FIG. 15: S22) or a cleaning operation using the cleaning mechanism 81 is completed (FIG. 15: S23). When the light emitted from the optical sensor 114 is not blocked by the indicator portion 62 of the sensor arm 60 (FIG. 15: No of S24), the control unit 90 terminates the re-determination of the exchange of the ink cartridge. That is, it is confirmed that the ink cartridge is not exchanged like the input from the user. The trigger signal, as a trigger, for determining the state of the remaining amount of ink after a printing operation for one page is completed (FIG. 15: S22) or a cleaning operation using the cleaning mechanism 81 is completed (FIG. 15: S23) corresponds to the second trigger signal in this embodiment.

On the other hand, when the light emitted from the optical sensor 114 is blocked by the indicator portion 62 of the sensor arm 60, it is determined that the remaining amount of ink inside the ink chamber 36 is a predetermined amount or more, that is, the full state (FIG. 15: Yes of S24). Then, the control unit 90 clears the count integrated value (FIG. 15: S25). Then, the control unit 90 terminates the re-determination of the exchange of the ink cartridge. This count integrated value corresponds to the first count value in this embodiment.

When a time of a printing operation for one page or a cleaning operation is elapsed, ink adhered to the inner wall of the remaining amount detecting unit 33 flows to be dropped therefrom, and the bubbles generated at the boundary surface of the ink of the ink chamber 36 are removed. Accordingly, when the detection signal indicating that the remaining amount of ink is the full state is output from the optical sensor 114 even after the time is elapsed, it is confirmed that the remaining amount of ink inside the ink chamber 36 is a predetermined amount or more. Although the user inputs the exchange of the ink cartridge 30, the input is wrong, and the ink cartridge 30 is exchanged. Accordingly, the current count integrated value is cleared.

On the other hand, the control unit 90 detects that the cover 13 is closed (FIG. 15: S26), and reads out the flag informing the inserted/extracted state of the ink cartridge 30. When the ink cartridge 30 is inserted or extracted (FIG. 15: Yes of S27), the control unit stores the state of the remaining amount of ink before the cover 13 is closed in the RAM 93 (FIG. 13: S3), and displays a screen asking the user to exchange the ink cartridge on the operation panel 14 as described above (FIG. 13: S4).

When the ink cartridge 30 is not inserted or extracted (FIG. 15: No of S27), light is emitted from the optical sensor 114 to the remaining amount detecting unit 33 of the ink cartridge 30. When the light emitted from the optical sensor 114 is blocked by the indicator portion 62 of the sensor arm 60, it is determined that the remaining amount of ink inside the ink chamber 36 is a predetermined amount or more, that is, the full state (FIG. 15: Yes of S28). In this case, as described above, the re-determination of the exchange of the ink cartridge is continuously performed in consideration of the influence of the ink adhered to the inner wall of the remaining amount detecting unit 33 or the bubbles generated at the boundary surface of the ink of the ink chamber 36.

On the other hand, when the light emitted from the optical sensor 114 is not blocked by the indicator portion 62 of the sensor arm 60, it is determined that the remaining amount of ink inside the ink chamber 36 is not a predetermined amount or more, that is, the near empty state or the empty state (FIG. 15: No of S28). Then, the control unit 90 terminates the re-determination of the exchange of the ink cartridge. That is, it is confirmed that the ink cartridge 30 is not exchanged like the input from the user.

Effect of the Embodiment

According to the embodiment, even when the input informing whether the ink cartridge 30 is exchanged is erroneously performed by a user, the exchange of the ink cartridge 30 may be reliably detected and the remaining amount of ink may be accurately detected.

Further, the count integrated value is not instantly reset even when it is determined that the state of the remaining amount of ink is the full state after the ink cartridge 30 is inserted into or extracted from the cartridge mounting unit 110, but the count integrated value is reset when it is determined that the state of the remaining amount of ink is the full state in response to the subsequent trigger signal. Accordingly, the count integrated value is not instantly reset even when the optical sensor 114 detecting the remaining amount detecting unit 33 outputs a signal informing the full state due to the adhered ink or bubbles. Then, when the state of the remaining amount of ink becomes the near empty state or the empty state due to the removal of bubbles or the like, the remaining amount of ink inside the ink cartridge 30 that is not exchanged is accurately detected.

First Modified Example

Hereinafter, a first modified example of the above-described embodiment will be described. In the above-described embodiment, the screen asking the user to exchange the ink cartridge is displayed on the operation panel 14 after the ink cartridge 30 is inserted to or extracted from the cartridge mounting unit 110, but the exchange of the ink cartridge may be determined without the inquiry.

Figure 16:
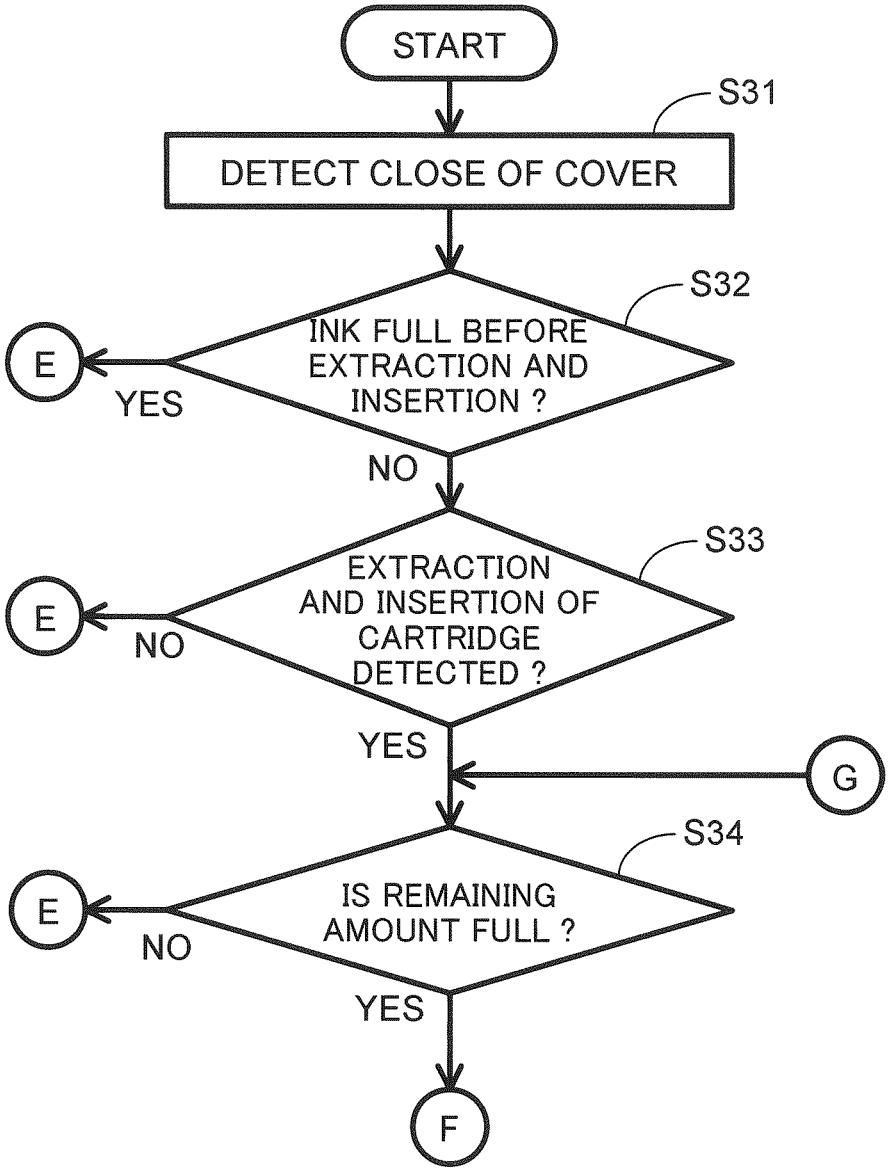
FIG. 16 is a flowchart illustrating the exchange determination process of the ink cartridge according to a first modified example.

When the control unit 90 detects that the cover 13 is closed (FIG. 16: S31), the control unit reads out whether the state of the remaining amount of ink is full before the cover 13 is opened (FIG. 16: S32). When the remaining amount of ink is the full state (FIG. 16: Yes of S32), the determination of the exchange of the ink cartridge is terminated. This is because the count integrated value after the near empty state is not influenced when the remaining amount of ink is the full state. The trigger signal, used as the trigger, for determining the state of the remaining amount of ink at this timing corresponds to the first trigger signal in this embodiment.

When the state of the remaining amount of ink is not the full state (FIG. 16: No of S32), the remaining amount detecting unit 33 checks whether the flag informing the inserted/extracted state of the ink cartridge 30 is stored in the RAM 93 (FIG. 16: S33). When the ink cartridge 30 is not inserted or extracted (FIG. 16: No of S33), the exchange of the ink cartridge is not determined, and the current process is terminated.

When the ink cartridge 30 is inserted or extracted (FIG. 16: Yes of S33), the control unit 90 emits light from the optical sensor 114 to the remaining amount detecting unit 33 of the ink cartridge 30 in response to the trigger signal based on the close of the cover 13. At this time, when the remaining amount of ink is not the full state (FIG. 16: No of S34), it is determined that the ink cartridge 30 is not exchanged, and the current process is terminated. The trigger signal, as the trigger, for determining the state of the remaining amount of ink at this timing corresponds to the second trigger signal in this embodiment.

When the state of the remaining amount of ink is the full state (FIG. 16: Yes of S34), the control unit 90 performs the re-determination of the exchange of the ink cartridge. Further, the count integrated value is not cleared herein. Specifically, the control unit 90 emits light from the optical sensor 114 to the remaining amount detecting unit 33 of the ink cartridge 30 after a printing operation for one page is completed (FIG. 17: S35) or a cleaning operation using the cleaning mechanism 81 is completed (FIG. 17: S36). When the light emitted from the optical sensor 114 is blocked by the indicator portion 62 of the sensor arm 60, it is determined that the remaining amount of ink inside the ink chamber 36 is a predetermined amount or more, that is, the full state (FIG. 17: Yes of S37). Then, the control unit 90 clears the count integrated value (FIG. 17: S38), and terminates the re-determination of the exchange of the ink cartridge. When a time of a printing operation for one page and a cleaning operation is elapsed, ink adhered to the inner wall of the remaining amount detecting unit 33 flows to be dropped therefrom, and the bubbles generated at the boundary surface of the ink of the ink chamber 36 are removed. Accordingly, when the detection signal indicating that the remaining amount of ink is the full state is output from the optical sensor 114 even after the time is elapsed, it is confirmed that the remaining amount of ink inside the ink chamber 36 is a predetermined amount or more. The trigger signal, as a trigger, for determining the state of the remaining amount of ink at this timing corresponds to the third trigger signal in this embodiment. Further, the cleared count integrated value corresponds to the first count value in this embodiment.

Figure 17:
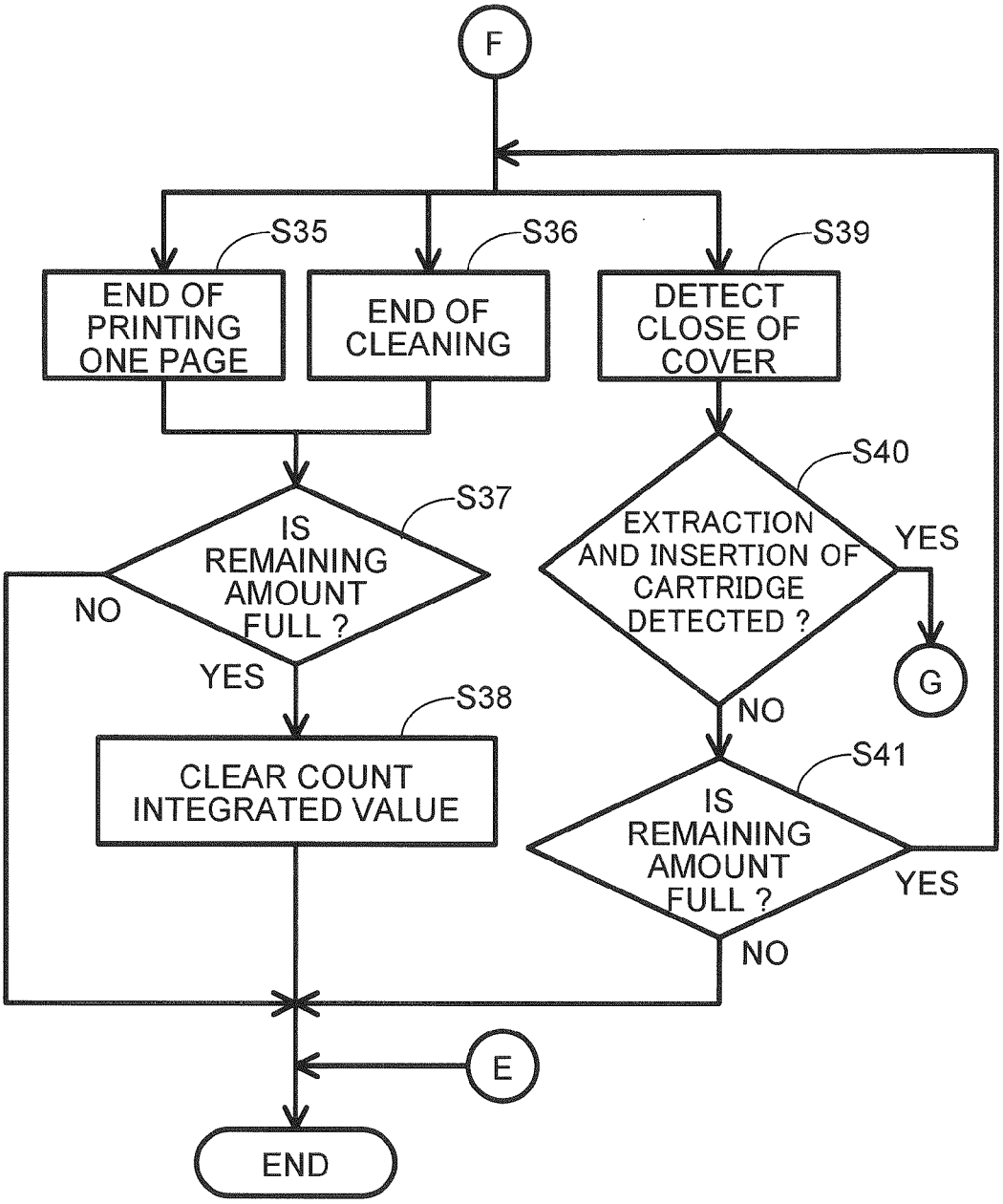
FIG. 17 is a flowchart illustrating the exchange determination process of the ink cartridge according to the first modified example.

On the other hand, when the light emitted from the optical sensor 114 is not blocked by the indicator portion 62 of the sensor arm 60, it is determined that the state of the remaining amount of ink inside the ink chamber 36 is not a predetermined amount or more, that is, the near empty state or the empty state (FIG. 17: No of S37). Then, the control unit 90 terminates the re-determination of the exchange of the ink cartridge without clearing the count integrated value.

The reason why the state of remaining amount of ink is the near empty state or the empty state when the above-described time is elapsed regardless of the state where the ink cartridge 30 is not exchanged is because the light emitted from the optical sensor 114 is temporarily blocked by the remaining amount detecting unit 33 due to the ink adhered to the inner wall of the remaining amount detecting unit 33 or the bubbles generated at the boundary surface of the ink of the ink chamber 36, and the remaining amount of ink inside the ink chamber 36 may not be a predetermined amount or more. At that time, it is confirmed that the ink cartridge 30 is not exchanged.

On the other hand, the control unit 90 reads out the flag informing the inserted/extracted state of the ink cartridge 30 after detecting the closed state of the cover 13 (FIG. 17: S39). When the ink cartridge 30 is inserted or extracted (FIG. 17: Yes of S40), the control unit emits light from the optical sensor 114 to the remaining amount detecting unit 33 of the ink cartridge 30 in response to the trigger signal based on the close of the cover 13 as described above (FIG. 16: S34).

When the ink cartridge 30 is not inserted or extracted (FIG. 17: No of S40), the control unit emits light from the optical sensor 114 to the remaining amount detecting unit 33 of the ink cartridge 30. When the light emitted from the optical sensor 114 is blocked by the indicator portion 62 of the sensor arm 60, it is determined that the state of the remaining amount of ink inside the ink chamber 36 is a predetermined amount or more, that is, the full state (FIG. 17: Yes of S41). In this case, as described above, the re-determination of the exchange of the ink cartridge is continuously performed in consideration of the influence of the ink adhered to the inner wall of the remaining amount detecting unit 33 or the bubbles generated at the boundary surface of the ink of the ink chamber 36.

On the other hand, when the light emitted from the optical sensor 114 is not blocked by indicator portion 62 of the sensor arm 60, it is determined that the remaining amount of ink inside the ink chamber 36 is not a predetermined amount or more, that is, the near empty state or the empty state (FIG. 17: No of S41). Then, the control unit 90 terminates the re-determination of the exchange of the ink cartridge without clearing the count integrated value. That is, it is confirmed that the ink cartridge 30 is not exchanged.

[Effect of First Modified Example]

According to the effect of the first modified example, the count integrated value is not instantly reset while determining that the ink cartridge is exchanged even when it is determined that the state of the remaining amount of ink is the full state after the ink cartridge 30 is inserted to or extracted from the cartridge mounting unit 110, but the count integrated value is reset when it is determined that the state of the remaining amount of ink is the full state in response to the subsequent trigger signal. Accordingly, the count integrated value is not instantly reset even when the optical sensor 114 detecting the remaining amount detecting unit 33 outputs a signal informing the full state due to the adhered ink or bubbles. Then, when the state of the remaining amount of ink becomes the near empty state or the empty state due to the removal of bubbles or the like, the remaining amount of ink inside the ink cartridge 30 that is not exchanged is accurately detected.

Second Modified Example

Hereinafter, a second modified example of the above-described embodiment will be described. In the above-described embodiment, the state where the ink cartridge 30 is inserted into or extracted from the cartridge mounting unit 110 may be detected. However, when the ink cartridge 30 is inserted into or extracted from the cartridge mounting unit 110 while the user turns off power, the control unit 90 may not detect the inserted/extracted state of the ink cartridge 30 or the opened/closed state of the cover 13. Accordingly, the exchange of the ink cartridge may be determined after power is turned on.

Figure 18:
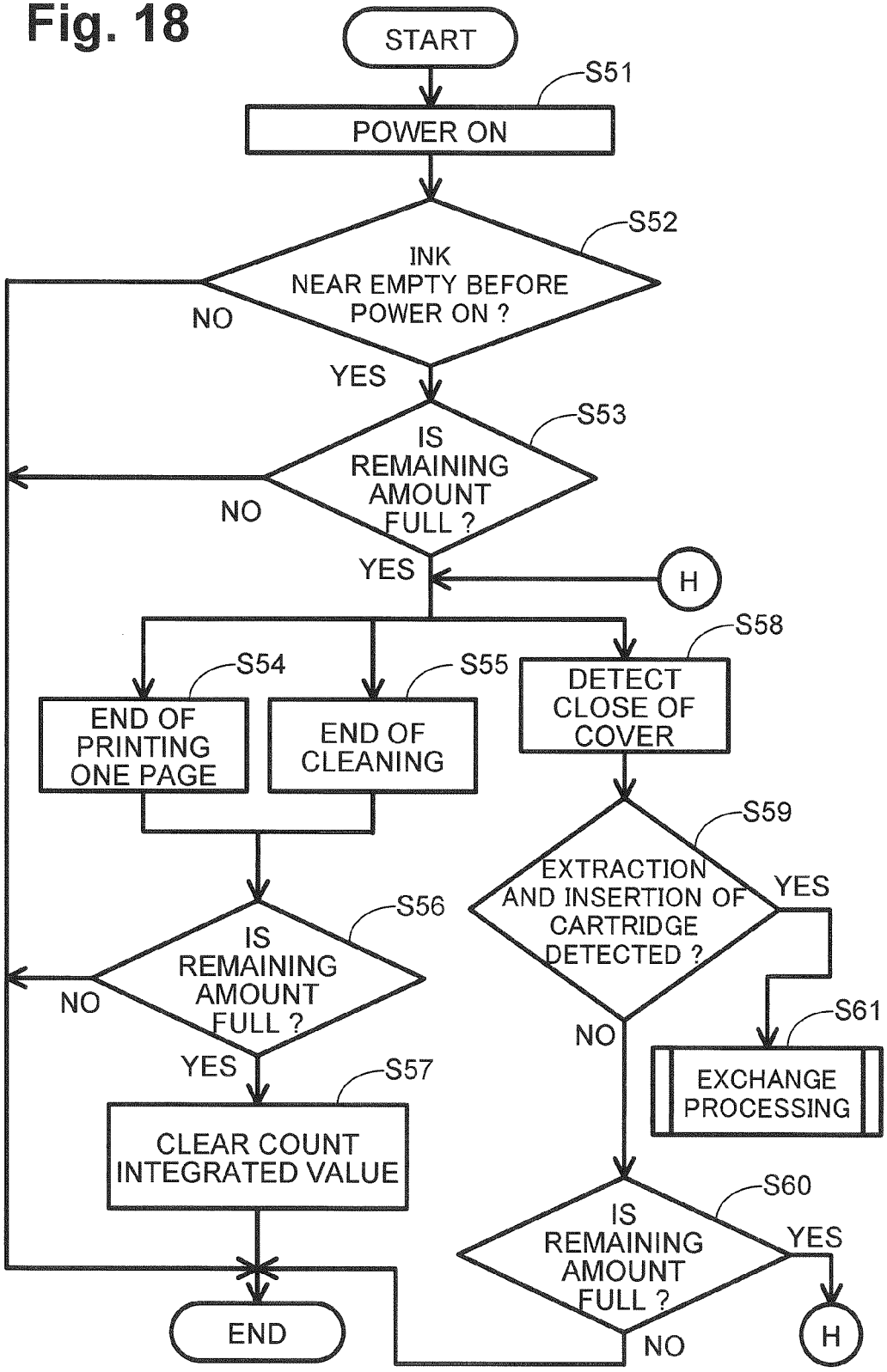
FIG. 18 is a flowchart illustrating the exchange determination process of the ink cartridge according to a second modified example.

When the control unit 90 detects that power is turned on (FIG. 18: S51), the control unit reads out whether the state of the remaining amount of ink before turning on power is the near empty state (FIG. 18: S52). When the state of the remaining amount of ink is not the near empty state (FIG. 18: No of S52), the determination of the exchange of the ink cartridge is terminated. When the state of the remaining amount of ink is not the near empty state, the count integrated value after the near empty state is hardly influenced. At this timing, the trigger signal, as a trigger, for determining the state of the remaining amount of ink corresponds to the fourth trigger signal in this embodiment.

When the state of the remaining amount of ink is the near empty state (FIG. 18: Yes of S52), the control unit 90 emits light from the optical sensor 114 to the remaining amount detecting unit 33 of the ink cartridge 30 in response to the trigger signal based on the state where power is turned on. At this time, when the state of the remaining amount of ink is not the full state (FIG. 18: No of S53), it is confirmed that the ink cartridge 30 is not exchanged, and the current process is terminated. The trigger signal, as a trigger, for determining the state of the remaining amount of ink at this timing corresponds to the fifth trigger signal in this embodiment.

When the state of the remaining amount of ink is the full state (FIG. 18: Yes of S53), the control unit 90 performs the re-determination of the exchange of the ink cartridge. Further, the count integrated value is not cleared herein. Specifically, the control unit 90 emits light from the optical sensor 114 to the remaining amount detecting unit 33 of the ink cartridge 30 after a printing operation for one page is completed (FIG. 18: S54) or a cleaning operation using the cleaning mechanism 81 is completed (FIG. 18: S55). When the light emitted from the optical sensor 114 is blocked by the indicator portion 62 of the sensor arm 60, it is determined that the state of the remaining amount of ink inside the ink chamber 36 is a predetermined amount or more, that is, the full state (FIG. 18: Yes of S56). Then, the control unit 90 clears the count integrated value (FIG. 18: S57), and terminates the re-determination of the exchange of the ink cartridge. When a time of a printing operation for one page and a cleaning operation is elapsed, ink adhered to the inner wall of the remaining amount detecting unit 33 flows to be dropped therefrom, and the bubbles generated at the boundary surface of the ink of the ink chamber 36 are removed. Accordingly, when the detection signal indicating that the remaining amount of ink is the full state is output from the optical sensor 114 even after the time is elapsed, it is confirmed that the remaining amount of ink inside the ink chamber 36 is a predetermined amount or more. The trigger signal, as a trigger, for determining the state of the remaining amount of ink at this timing corresponds to the sixth trigger signal in this embodiment.

On the other hand, when the light emitted from the optical sensor 114 is not blocked by the indicator portion 62 of the sensor arm 60, it is determined that the state of the remaining amount of ink inside the ink chamber 36 is not a predetermined amount or more, that is, the near empty state or the empty state (FIG. 18: No of S56). Then, the control unit 90 terminates the re-determination of the exchange of the ink cartridge without clearing the count integrated value.

The reason why the state of remaining amount of ink is the near empty state or the empty state when the above-described time is elapsed regardless of the state where the ink cartridge 30 is not exchanged is because the light emitted from the optical sensor 114 is temporarily blocked by the remaining amount detecting unit 33 due to the ink adhered to the inner wall of the remaining amount detecting unit 33 or the bubbles generated at the boundary surface of the ink of the ink chamber 36, and the remaining amount of ink inside the ink chamber 36 may not be a predetermined amount or more. At that time, it is confirmed that the ink cartridge 30 is not exchanged.

On the other hand, the control unit 90 reads out the flag informing the inserted/extracted state of the ink cartridge 30 after detecting the closed state of the cover 13 (FIG. 18: S58). When the ink cartridge 30 is inserted or extracted (FIG. 18: Yes of S59), the control unit 90 performs the determination of the ink exchange process (S61) as in the embodiment or the first modified example described above.

When the ink cartridge 30 is not inserted or extracted (FIG. 18: No of S59), the control unit 90 emits light from the optical sensor 114 to the remaining amount detecting unit 33 of the ink cartridge 30. When the light emitted from the optical sensor 114 is blocked by the indicator portion 62 of the sensor arm 60, it is determined that the state of the remaining amount of ink inside the ink chamber 36 is a predetermined amount or more, that is, the full state (FIG. 18: Yes of S60). In this case, as described above, the re-determination of the exchange of the ink cartridge is continuously performed in consideration of the influence of the ink adhered to the inner wall of the remaining amount detecting unit 33 or the bubbles generated at the boundary surface of the ink of the ink chamber 36.

On the other hand, when the light emitted from the optical sensor 114 is not blocked by indicator portion 62 of the sensor arm 60, it is determined that the remaining amount of ink inside the ink chamber 36 is not a predetermined amount or more, that is, the near empty state or the empty state (FIG. 18: No of S60). Then, the control unit 90 terminates the re-determination of the exchange of the ink cartridge without clearing the count integrated value. That is, it is confirmed that the ink cartridge 30 is not exchanged.

[Effect of Second Modified Example]

According to the second modified example, even when the ink cartridge 30 is exchanged while power is turned off, the exchange of the ink cartridge 30 may be reliably detected, and the remaining amount of ink may be accurately detected.

What is claimed is:

1. An image printing apparatus comprising:

a printer unit including a cartridge mounting unit configured such that an ink cartridge is detachably mountable thereon, the printer unit being configured to print an image on a printing medium by ejecting ink supplied from the ink cartridge as ink droplets, wherein the ink cartridge includes:

an ink chamber configured to store the ink;

an ink supply port configured to discharge the ink stored in the ink chamber; and a remaining amount detecting portion configured to receive the ink from the ink chamber and configured such that a light transmission state changes in accordance with a remaining amount of the ink stored in the ink chamber, wherein the cartridge mounting unit includes:

a connecting portion configured to be connected to the ink supply port so as to receive the ink from the ink supply port while the ink cartridge is mounted on the cartridge mounting unit; and a sensor configured to detect a light transmitted through the remaining amount detecting portion while the ink cartridge is mounted on the cartridge mounting unit, and wherein the image printing apparatus further comprises:

a counter configured to count the ink droplets ejected from the printer unit;

a trigger signal generating section configured to generate trigger signals;

an ink remaining amount determining section configured to, in response to the trigger signals generated by the trigger signal generating section, determine at least two states of the remaining amount of the ink stored in the ink chamber on the basis of an output signal of the sensor;

a first storage section configured to store an ink remaining amount state determined by the ink remaining amount determining section;

a second storage section configured to store a value obtained by integrating a first count number counted by the counter after the ink remaining amount determining section determines that the remaining amount of the ink is in a first state corresponding to a small remaining amount of the ink between the two states;

an operation detecting section configured to detect that the cartridge mounting unit is operated to extract and mount the ink cartridge;

an operation panel configured to receive an input, by a user, informing that the detection result of the operation detecting section is based on extraction of a first one of the ink cartridge and mounting of a second one of the ink cartridge different from the first one of the ink cartridge;

a first reset section configured to clear the value stored in the second storage section on the condition that:

the ink remaining amount determining section determines that it is in the first state in response to a first trigger signal before the operation detecting section detects that the cartridge mounting unit is operated;

the ink remaining amount determining section determines that it is in a second state corresponding to a large remaining amount of the ink between the two states, in response to a second trigger signal generated after the operation detecting section detects that the cartridge mounting unit is operated; and the operation panel receives the input, by the user, informing that the detection result of the operation detecting section is based on extraction of the first one of the ink cartridge and mounting of the second one of the ink cartridge different from the first one of the ink cartridge;

a temporary count holding section configured to:

temporarily store, as an initial value, the integrated value stored in the second storage section before the value is cleared by the first reset section;

store a second count number obtained by integrating the initial value with a count number counted by the counter until a third trigger signal is generated after the second trigger signal is generated; and store the second count number in the second storage section on the condition that the ink remaining amount determining section determines that it is in the first state in response to the third trigger signal.

2. The image printing apparatus according to claim 1, wherein the ink remaining amount determining section determines that it is in a third state having no remaining amount of the ink stored in the ink chamber on the condition that the integrated value stored in the second storage section is more than a threshold value after it is determined that the remaining amount of the ink is in the first state.

3. The image printing apparatus according to claim 2, further comprising:

an ink remaining amount display section configured to display at least three states of remaining amount of the ink corresponding to the first state, the second state, and the third state of the ink cartridge on the basis of the determination result of the ink remaining amount determining section.

4. The image printing apparatus according to claim 1, further comprising:

a cleaning mechanism configured to suck and remove the ink from the printer unit, wherein the trigger signal generating section is configured to generate the third trigger signal on the condition that the operation detecting section detects that the cartridge mounting unit is operated, the printer unit performs an image printing operation, or the cleaning mechanism is operated.

5. The image printing apparatus according to claim 1, further comprising a cover configured to cover the cartridge mounting unit, wherein the operation detecting section is configured to detect whether the cover is closed and to determine that the cartridge mounting unit is operated when the cover is detected to be closed.

6. An image printing apparatus comprising:

a printer unit including a cartridge mounting unit configured such that an ink cartridge is detachably mountable thereon, the printer unit being configured to print an image on a printing medium by ejecting ink supplied from the ink cartridge as ink droplets, wherein the ink cartridge includes:

an ink chamber configured to store the ink;

an ink supply port configured to discharge the ink stored in the ink chamber; and a remaining amount detecting portion configured to receive the ink from the ink chamber and configured such that a light transmission state changes in accordance with a remaining amount of the ink stored in the ink chamber, wherein the cartridge mounting unit includes:

a connecting portion configured to be connected to the ink supply port so as to receive the ink from the ink supply port while the ink cartridge is mounted on the cartridge mounting unit; and a sensor configured to detect a light transmitted through the remaining amount detecting portion while the ink cartridge is mounted on the cartridge mounting unit, and wherein the image printing apparatus further comprises:

a counter configured to count the ink droplets ejected from the printer unit;

a trigger signal generating section configured to generate trigger signals;

an ink remaining amount determining section configured to, in response to the trigger signals generated by the trigger signal generating section, determine at least two states of the remaining amount of the ink stored in the ink chamber on the basis of an output signal of the sensor;

a first storage section configured to store an ink remaining amount state determined by the ink remaining amount determining section;

a second storage section configured to store a value obtained by integrating a first count number counted by the counter after the ink remaining amount determining section determines that the remaining amount of the ink is in a first state corresponding to a small remaining amount of the ink between the two states;

an operation detecting section configured to detect that the cartridge mounting unit is operated to extract and mount the ink cartridge;

an operation panel configured to receive an input, by a user, informing that the detection result of the operation detecting section is based on extraction of a first one of the ink cartridge and mounting of a second one of the ink cartridge different from the first one of the ink cartridge; and a second reset section configured to clear the integrated value stored in the second storage section on the condition that:

the ink remaining amount determining section determines that it is in the first state in response to the first trigger signal before the operation detecting section detects that the cartridge mounting unit is operated;

the operation panel receives an input, by the user, informing that the detection result of the operation detecting section is based on extraction of the first one of the ink cartridge and mounting of the second one of the ink cartridge different from the first one of the ink cartridge; and the ink remaining amount determining section determines that it in is a second state having a large remaining amount of ink between the two states in response to a second trigger signal generated after the operation detecting section detects that the cartridge mounting unit is operated.

7. The image printing apparatus according to claim 6, wherein the ink remaining amount determining section determines that it is in a third state having no remaining amount of the ink stored in the ink chamber on the condition that the integrated value stored in the storage section is more than a threshold value after it is determined that the remaining amount of the ink is in the first state.

8. The image printing apparatus according to claim 7, further comprising:

an ink remaining amount display section configured to display at least three states of remaining amount of the ink corresponding to the first state, the second state, and the third state of the ink cartridge on the basis of the determination result of the ink remaining amount determining section.

9. The image printing apparatus according to claim 6, further comprising:

a cleaning mechanism configured to suck and remove the ink from the printer unit, wherein the trigger signal generating section is configured to generate the second trigger signal on the condition that the printer unit performs an image printing operation or the cleaning mechanism is operated.

10. The image printing apparatus according to claim 6, further comprising a cover configured to cover the cartridge mounting unit, wherein the operation detecting section is configured to detect whether the cover is closed and to determine that the cartridge mounting unit is operated when the cover is detected to be closed.

11. An image printing apparatus comprising:

a printer unit including a cartridge mounting unit configured such that an ink cartridge is detachably mountable thereon, the printer unit being configured to print an image on a printing medium by ejecting ink supplied from the ink cartridge as ink droplets, wherein the ink cartridge includes:

an ink chamber configured to store the ink;

an ink supply port configured to discharge the ink stored in the ink chamber; and a remaining amount detecting portion configured to receive the ink from the ink chamber and configured such that a light transmission state changes in accordance with a remaining amount of the ink stored in the ink chamber, wherein the cartridge mounting unit includes:

a connecting portion configured to be connected to the ink supply port so as to receive the ink from the ink supply port while the ink cartridge is mounted on the cartridge mounting unit; and a sensor configured to detect a light transmitted through the remaining amount detecting portion while the ink cartridge is mounted on the cartridge mounting unit, and wherein the image printing apparatus further comprises:

a counter configured to count the ink droplets ejected from the printer unit;

a trigger signal generating section configured to generate trigger signals;

an ink remaining amount determining section configured to, in response to the trigger signals generated by the trigger signal generating section, determine at least two states of the remaining amount of the ink stored in the ink chamber on the basis of an output signal of the sensor;

a first storage section configured to store an ink remaining amount state determined by the ink remaining amount determining section;

a second storage section configured to store a value obtained by integrating a first count number counted by the counter after the ink remaining amount determining section determines that the remaining amount of the ink is in a first state corresponding to a small remaining amount of the ink between the two states;

an operation detecting section configured to detect whether the cartridge mounting unit is operated; and a third reset section configured to clear the integrated value stored in the second storage section on the condition that:

the ink remaining amount determining section determines that it is in the first state in response to the first trigger signal before the operation detecting section detects that the cartridge mounting unit is operated;

the ink remaining amount determining section determines that it is in a second state corresponding to a large remaining amount of the ink between the two states, in response to a second trigger signal generated after the operation detecting section detects that the cartridge mounting unit is operated; and the ink remaining amount determining section determines that it is in the second state in response to a third trigger signal, generated after the ink consumption, subsequently after the second trigger signal.

12. The image printing apparatus according to claim 11, wherein the ink remaining amount determining section determines that it is in a third state having no remaining amount of the ink stored in the ink chamber on the condition that the integrated value stored in the second storage section is more than a threshold value after it is determined that the remaining amount of the ink is in the first state.

13. The image printing apparatus according to claim 11, further comprising:

a cleaning mechanism configured to suck and remove the ink from the printer unit, wherein the trigger signal generating section is configured to generate the third trigger signal on the condition that the operation detecting section detects that the printer unit performs an image printing operation or the cleaning mechanism is operated.

14. The image printing apparatus according to claim 11, further comprising a cover configured to cover the cartridge mounting unit, wherein the operation detecting section is configured to detect whether the cover is closed and to determine that the cartridge mounting unit is operated when the cover is detected to be closed.

15. An image printing apparatus comprising:

a printer unit including a cartridge mounting unit configured such that an ink cartridge is detachably mountable thereon, the printer unit being configured to print an image on a printing medium by ejecting ink supplied from the ink cartridge as ink droplets, wherein the ink cartridge includes:

an ink chamber configured to store the ink;

an ink supply port configured to discharge the ink stored in the ink chamber; and a remaining amount detecting portion configured to receive the ink from the ink chamber and configured such that a light transmission state changes in accordance with a remaining amount of the ink stored in the ink chamber, wherein the cartridge mounting unit includes:

a connecting portion configured to be connect to the ink supply port so as to receive the ink from the ink supply port while the ink cartridge is mounted on the cartridge mounting unit; and a sensor configured to detect a light transmitted through the remaining amount detecting portion while the ink cartridge is mounted on the cartridge mounting unit, and wherein the image printing apparatus further comprises:

a counter configured to count the ink droplets ejected from the printer unit;

a trigger signal generating section configured to generate trigger signals;

an ink remaining amount determining section configured to, in response to the trigger signals generated by the trigger signal generating section, determine at least two states of the remaining amount of the ink stored in the ink chamber on the basis of an output signal of the sensor;

a first storage section configured to store an ink remaining amount state determined by the ink remaining amount determining section;

a second storage section configured to store a value obtained by integrating a first count number counted by the counter after the ink remaining amount determining section determines that the remaining amount of the ink is in a first state corresponding to a small remaining amount of the ink between the two states;

a power detecting section configured to detect whether the image printing apparatus changes from an OFF state to an ON state; and a fourth reset section configured to clear the integrated value stored in the second storage section on the condition that:

the ink remaining amount determining section determines that it is in the first state in response to a fourth trigger signal before the power detecting section detects that the power is turned on;

the ink remaining amount determining section determines that it is in a second state corresponding to a large remaining amount of the ink between the two states, in response to a fifth trigger signal generated after the power detecting section detects that the power is turned on; and the ink remaining amount determining section determines that it is in the second state in response to a sixth trigger signal, generated after ink consumption, subsequently after the fifth trigger signal.

16. The image printing apparatus according to claim 15, further comprising:

a cleaning mechanism configures to suck and remove the ink from the printer unit, wherein the trigger signal generating section generates the sixth trigger signal on the condition that the printer unit performs an image printing operation or the cleaning mechanism is operated.

17. An image printing apparatus comprising:

a cartridge mounting unit configured such that a cartridge, including a printing material, is detachably mountable thereon;

an operation detecting section configured to detect that the cartridge mounting unit is operated to extract and mount the ink cartridge;

an operation panel configured to receive an input, by a user, informing that the detection result of the operation detecting section is based on extraction of a first one of the cartridge and mounting of a second one of the cartridge different from the first one of the cartridge;

an exchange determination unit configured to determine that the detection result of the operation detecting section is based on extraction of the first one of the cartridge and mounting of the second one of the cartridge, based on the input via the operation panel;

an operation detecting section configured to detect whether a predetermined operation is operated, wherein the predetermined operation does not comprise receiving the input via the operation panel by the user; and an exchange re-determination unit configured to re-determine that the detection result of the operation detecting section is based on extraction of the first one of the cartridge and mounting of the second one of the cartridge.

* * * * *